US012391352B2

(12) United States Patent
Onoue et al.

(10) Patent No.: US 12,391,352 B2
(45) Date of Patent: Aug. 19, 2025

(54) OUTBOARD MOTOR

(71) Applicant: YAMAHA HATSUDOKI KABUSHIKI KAISHA, Iwata (JP)

(72) Inventors: Junya Onoue, Shizuoka (JP); Hiroki Koga, Shizuoka (JP); Yoshiyuki Kadobayashi, Shizuoka (JP); Kimitaka Saruwatari, Shizuoka (JP); Akihiro Noma, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 467 days.

(21) Appl. No.: 17/994,425

(22) Filed: Nov. 28, 2022

(65) Prior Publication Data

US 2023/0348035 A1 Nov. 2, 2023

(30) Foreign Application Priority Data

May 2, 2022 (JP) ..... 2022-075993

(51) Int. Cl.

| | |
|---|---|
| ***B63H 20/28*** | (2006.01) |
| ***B63H 20/02*** | (2006.01) |
| ***B63H 20/14*** | (2006.01) |
| ***B63H 20/32*** | (2006.01) |

(52) U.S. Cl.

CPC ..... *B63H 20/285* (2013.01); *B63H 20/02* (2013.01); *B63H 20/14* (2013.01); *B63H 20/32* (2013.01)

(58) Field of Classification Search

CPC ..... B63H 20/285; B63H 20/02; B63H 20/14; B63H 20/32

See application file for complete search history.

(56) References Cited

U.S. PATENT DOCUMENTS

| | | | | |
|---|---|---|---|---|
| 2015/0017847 | A1* | 1/2015 | Kubo | B63H 20/14 440/75 |
| 2015/0367925 | A1 | 12/2015 | Oguma et al. | |
| 2021/0001969 | A1* | 1/2021 | Ikegaya | B63H 20/28 |
| 2021/0024193 | A1* | 1/2021 | Nakamura | B63H 20/007 |

FOREIGN PATENT DOCUMENTS

| | | | |
|---|---|---|---|
| JP | 2015067191 A | * | 4/2015 |
| JP | 2016-005927 A | | 1/2016 |

* cited by examiner

*Primary Examiner* — Stephen P Avila
(74) *Attorney, Agent, or Firm* — Keating & Bennett, LLP

(57) ABSTRACT

An outboard motor includes an upper case, a lower case, a transmission, a clutch, a cooling water passage, a first pump, and a second pump. The transmission is operable to transmit the driving force of the engine. The clutch is connected to the transmission. The cooling water passage is connected to the engine. The cooling water passage is located in the upper case and the lower case. The first pump is connected to the transmission via the clutch. The first pump is driven by the driving force of the engine to send cooling water to the engine through the cooling water passage. The second pump is connected to the transmission. The second pump is driven by the driving force of the engine to send the cooling water to the engine through the cooling water passage.

7 Claims, 32 Drawing Sheets

OUTBOARD MOTOR

CROSS REFERENCE TO RELATED APPLICATIONS

This application claims the benefit of priority to Japanese Patent Application No. 2022-075993 filed on May 2, 2022. The entire contents of this application are hereby incorporated herein by reference.

BACKGROUND OF THE INVENTION

1. Field of the Invention

The present invention relates to an outboard motor.

2. Description of the Related Art

An outboard motor includes a cooling water passage and a pump for supplying cooling water to the engine. A water intake is provided at the bottom of the outboard motor, and the cooling water passage is connected to the engine and the water intake. The pump delivers the cooling water to the engine through the cooling water passage.

For example, the outboard motor disclosed in JP-A-2016-5927 includes a first pump and a second pump. The first pump and the second pump are connected to the drive shaft. The drive shaft is connected to the crankshaft of the engine. The driving force from the engine rotates the drive shaft to drive the first pump and the second pump. Thus, the first pump and the second pump send the cooling water to the engine through the cooling water passage.

As mentioned above, if the water pump is driven by the driving force from the engine, the water pump will be driven whenever the engine is rotating, so even if cooling is not required, the cooling water will be supplied to the engine. In addition, since the amount of cooling water supplied changes according to the rotational speed of the engine, it is not easy to supply the engine with an amount of cooling water suitable for cooling the engine.

SUMMARY OF THE INVENTION

Preferred embodiments of the present invention supply an appropriate amount of cooling water to outboard motors to cool engines of the outboard motors.

An outboard motor according to a preferred embodiment of the present invention includes a bracket, an upper case, a lower case, a transmission, a clutch, a cooling water passage, a first pump, and a second pump. The outboard motor is attached to a watercraft via the bracket. The upper case is below the engine. The lower case is below the upper case. The transmission is operable to transmit the driving force of the engine. The clutch is connected to the transmission. The cooling water passage is connected to the engine. The cooling water passage is located in the upper case and the lower case. The first pump is connected to the transmission via the clutch. The first pump is driven by the driving force of the engine to send cooling water to the engine through the cooling water passage. The second pump is connected to the transmission. The second pump is driven by the driving force of the engine to send cooling water to the engine through the cooling water passage.

In an outboard motor according to a preferred embodiment of the present invention, connection and disconnection between the first pump and the transmission are switched by the clutch. Thus, the clutch switches between a state in which the cooling water is supplied to the engine by both the first pump and the second pump, and a state in which the cooling water is supplied to the engine only by the second pump. Thus, an appropriate amount of cooling water is supplied to the engine to cool the engine.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
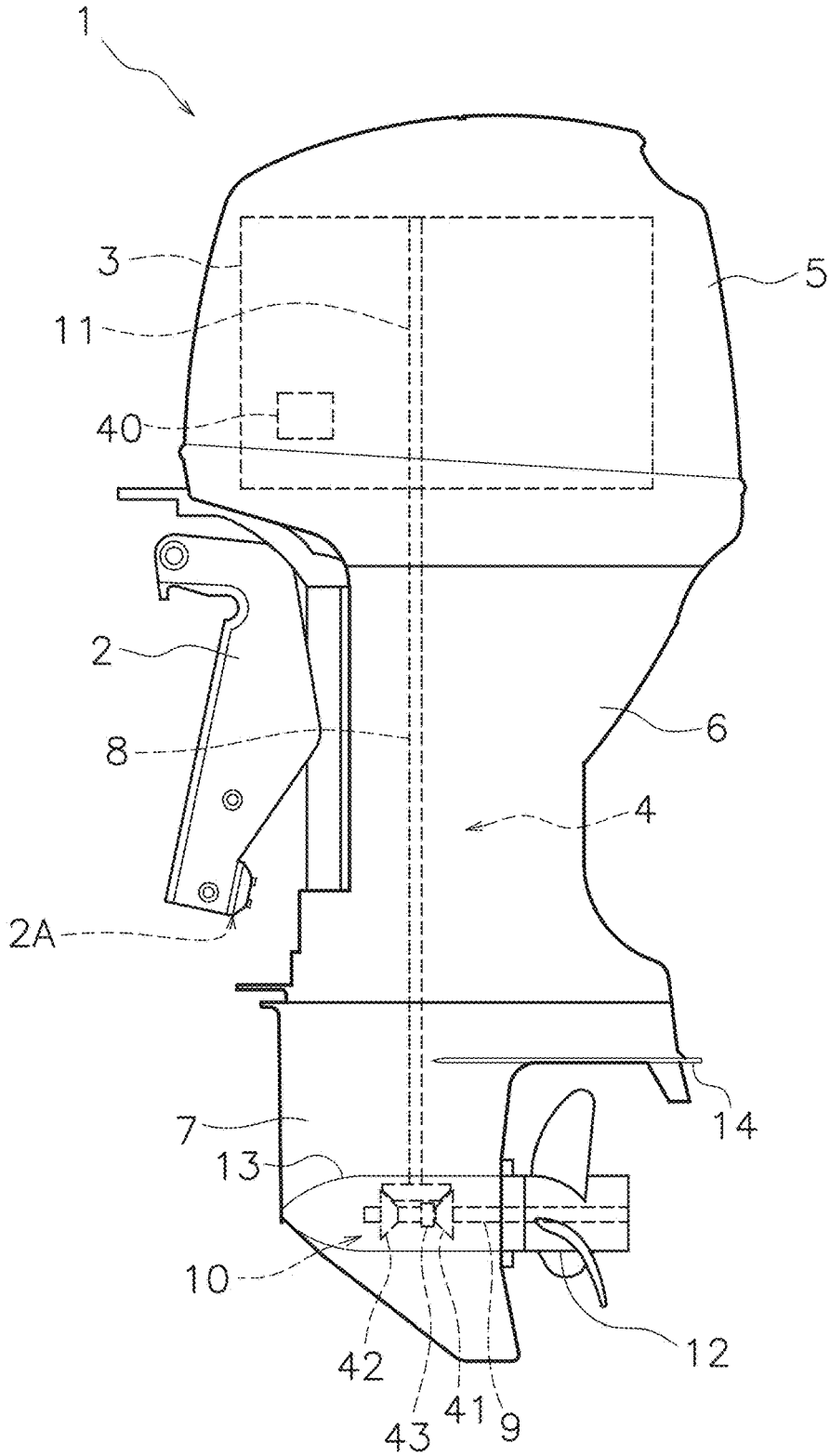
FIG. 1 is a side view of an outboard motor according to a preferred embodiment of the present invention.

Preferred embodiments of the present invention will be described below with reference to the drawings. FIG. 1 is a side view of an outboard motor 1 according to a preferred embodiment. The outboard motor 1 includes a bracket 2, an engine 3, a transmission mechanism 4, an engine cowl 5, an upper case 6, and a lower case 7. The outboard motor 1 is attached to a watercraft via the bracket 2.

The engine 3 generates thrust to propel the watercraft. The engine 3 includes a crankshaft 11. The crankshaft 11 extends in the vertical direction of the outboard motor 1. The transmission mechanism 4 transmits the driving force of the engine 3 to a propeller 12. The transmission mechanism 4 includes a drive shaft 8, a propeller shaft 9, and a shift mechanism 10. The drive shaft 8 is connected to the crankshaft 11. The drive shaft 8 extends in the vertical direction of the outboard motor 1. The drive shaft 8 extends downward from the engine 3.

The propeller shaft 9 extends in the front-rear direction of the outboard motor 1. The propeller shaft 9 is connected to the drive shaft 8 via the shift mechanism 10. The propeller 12 is attached to the propeller shaft 9. The shift mechanism 10 switches the transmission direction of rotation from the drive shaft 8 to the propeller shaft 9. As a result, the watercraft is switched between forward and reverse.

Figure 2A:
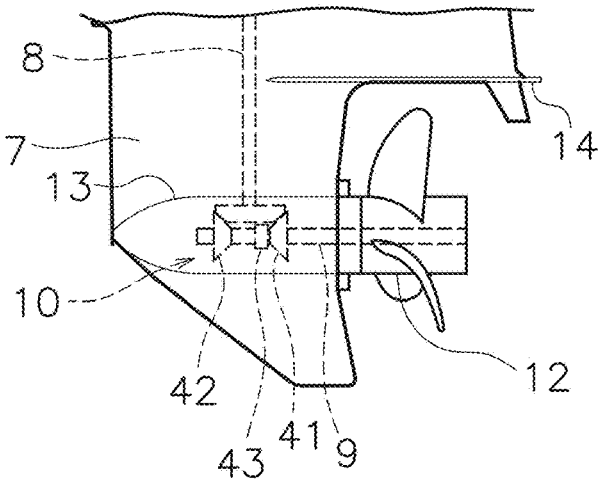
FIG. 2A is an enlarged side view showing a portion of the outboard motor.
Figure 2B:
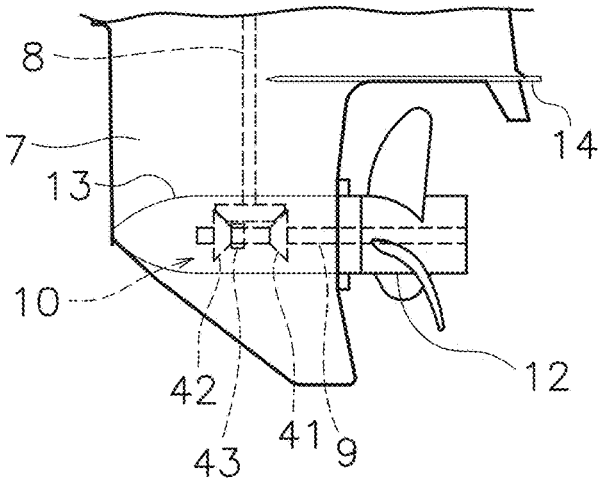
FIG. 2B is an enlarged side view showing a portion of the outboard motor.

Specifically, the shift mechanism 10 includes a forward gear 41, a reverse gear 42, and a clutch 43. The clutch 43 engages the forward gear 41 in the forward position shown in FIG. 2A. As a result, the propeller shaft 9 rotates forward. The clutch 43 engages the reverse gear 42 in the reverse position shown in FIG. 2B. As a result, the reverse gear 42 is connected to the propeller shaft 9 to connect the drive shaft 8 to the propeller shaft 9 via the reverse gear 42. As a result, the propeller shaft 9 rotates in the reverse direction.

Figure 2C:
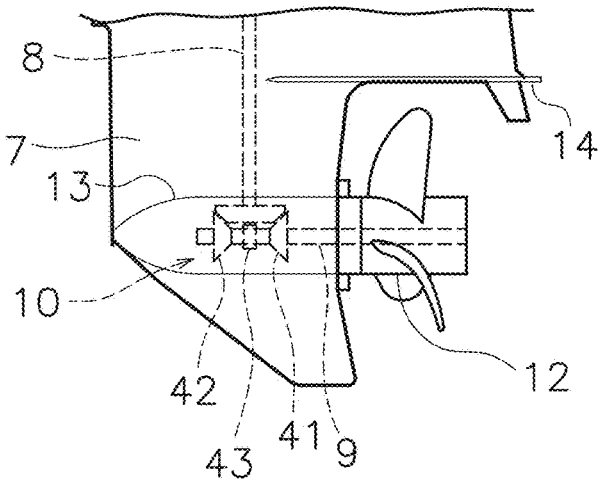
FIG. 2C is an enlarged side view showing a portion of the outboard motor.

The propeller shaft 9 is not connected to either the forward gear 41 or the reverse gear 42 when the clutch 43 is in the neutral position shown in FIG. 2C. Thus, the drive shaft 8 and the propeller shaft 9 are disconnected. As described above, the shift mechanism 10 is in a driving state in which the driving force from the drive shaft 8 is transmitted to the propeller shaft 9 when the clutch 43 is in the forward position or the reverse position. When the clutch 43 is in the neutral position, the shift mechanism 10 is in a neutral state in which the driving force from the drive shaft 8 is not transmitted to the propeller shaft 9.

The engine 3 is disposed in the engine cowl 5. The upper case 6 is disposed below the engine 3. The lower case 7 is disposed below the upper case 6. The drive shaft 8 is disposed in the upper case 6 and the lower case 7. The propeller shaft 9 and the shift mechanism 10 are disposed in the lower case 7. Specifically, the lower case 7 includes a torpedo portion 13. The torpedo portion 13 has an outwardly bulging shape. The propeller shaft 9 and the shift mechanism 10 are disposed in the torpedo portion 13. A cavitation plate 14 is connected to the lower case 7. The cavitation plate 14 protrudes rearward from the lower case 7.

Figure 3:
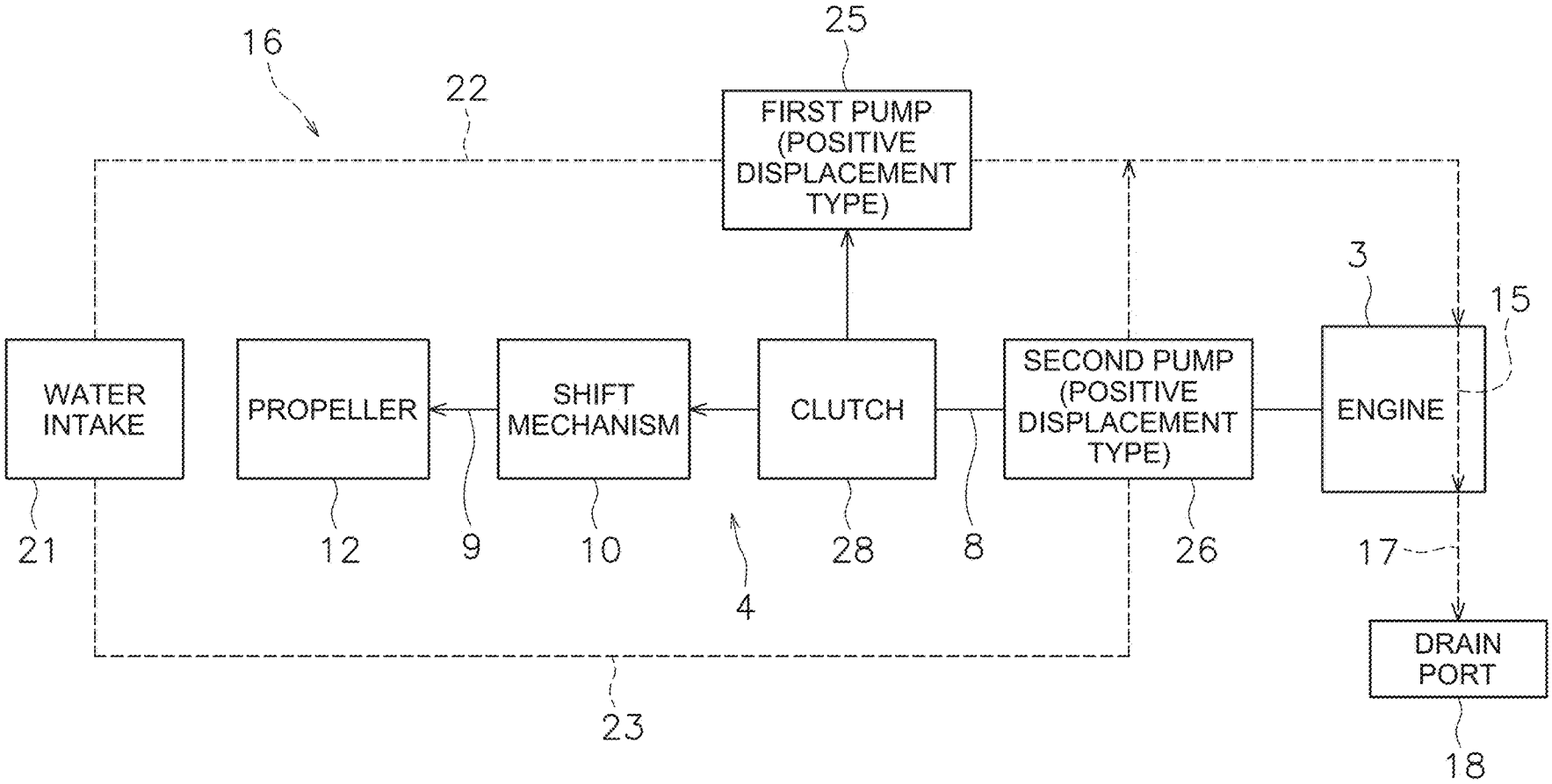
FIG. 3 is a block diagram showing a cooling system of an outboard motor according to a first preferred embodiment of the present invention.

FIG. 3 is a block diagram showing a cooling system and a drive system of the outboard motor 1 according to a first preferred embodiment of the present invention. A dashed arrow in FIG. 3 indicates the cooling system of the outboard motor 1. As shown in FIG. 3, the engine 3 includes a water jacket 15. The cooling water flowing through the water jacket 15 cools the engine 3. The outboard motor 1 includes a cooling water passage 16 and a drain passage 17. The cooling water passage 16 and the drain passage 17 are connected to the water jacket 15 of the engine 3. The cooling water passage 16 and the drain passage 17 are disposed in the upper case 6 and the lower case 7, for example.

The cooling water is supplied from the outside of the outboard motor 1 to the water jacket 15 of the engine 3 through the cooling water passage 16. The cooling water is discharged from the water jacket 15 to the outside of the outboard motor 1 through the drain passage 17 and a drain port 18. The drain port 18 is provided in the lower case 7, for example. Alternatively, the drain port 18 may be provided in the upper case 6.

The cooling water passage 16 includes a water intake 21, a first passage 22, and a second passage 23. The outboard motor 1 includes a first pump 25 and a second pump 26. The water intake 21 is provided in the lower case 7. The water intake 21 communicates with the outside of the outboard motor 1. The cooling water is drawn into the cooling water passage 16 from the outside of the outboard motor 1 through the water intake 21.

The first passage 22 is connected to the water intake 21. The first pump 25 is provided in the first passage 22. The second passage 23 is connected to the water intake 21. The second pump 26 is provided in the second passage 23. The first passage 22 and the second passage 23 are connected to the water jacket 15. The first pump 25 sends the cooling water to the engine 3 through the first passage 22. The second pump 26 sends the cooling water to the engine 3 through the second passage 23.

In FIG. 3, solid arrows indicate the drive system of the outboard motor 1. As shown in FIG. 3, the outboard motor 1 includes a clutch 28. The clutch 28 is connected to the transmission mechanism 4. The first pump 25 is connected to the transmission mechanism 4 via the clutch 28. The second pump 26 is connected to the transmission mechanism 4.

Specifically, the first pump 25 is connected between the engine 3 and the shift mechanism 10 in the transmission mechanism 4 via the clutch 28. The second pump 26 is connected between the engine 3 and the shift mechanism 10 in the transmission mechanism 4. For example, the first pump 25 is connected to the crankshaft 11 or the drive shaft 8 via the clutch 28. The second pump 26 is connected to the crankshaft 11 or the drive shaft 8.

The clutch 28 is, for example, a centrifugal clutch. Alternatively, the clutch 28 may be an electromagnetic clutch or a torque limiter. The clutch 28 is switched between an engaged state and a disengaged state according to the engine speed. The clutch 28 connects the first pump 25 to the transmission mechanism 4 in the engaged state. The clutch 28 disconnects the first pump 25 from the transmission mechanism 4 in the disengaged state.

For example, if the clutch 28 is a centrifugal clutch, the clutch 28 is maintained in the disengaged state when the engine speed is less than a predetermined threshold. When the engine speed reaches or exceeds the predetermined threshold, the clutch 28 is switched to the engaged state. If the clutch 28 is an electromagnetic clutch, the engine speed is detected by a sensor. The clutch 28 is electrically controlled by a command signal from controller 40 shown in FIG. 1 according to the engine speed detected by the sensor. Thus, the clutch 28 is switched between the engaged state and the disengaged state according to the engine speed.

In the first preferred embodiment, both the first pump 25 and the second pump 26 are positive displacement pumps. When the clutch 28 is in the engaged state, the driving force from the engine 3 is transmitted to the first pump 25 via the transmission mechanism 4 and the clutch 28. Thus, the first pump 25 is driven by the driving force of the engine 3 to send the cooling water to the engine 3 through the cooling water passage 16. When the clutch 28 is in the disengaged state, the driving force from the engine 3 is not transmitted to the first pump 25 and the first pump 25 is not driven.

The second pump 26 is always connected to the transmission mechanism 4. Therefore, the driving force from the engine 3 is always transmitted to the second pump 26 while the engine 3 is being driven. Thus, the second pump 26 is driven by the driving force of the engine 3 to send the cooling water to the engine 3 through the cooling water passage 16.

In the first preferred embodiment, when the engine speed is in the low speed range, the clutch 28 disconnects the first pump 25 and the transmission mechanism 4, and the second pump 26 is driven. Thus, the first pump 25 is not driven, and the cooling water is sent to the engine 3 only by the second pump 26. When the engine speed is in the high speed range, the clutch 28 connects the first pump 25 and the transmission mechanism 4, and the first pump 25 and the second pump 26 are driven. Thus, the cooling water is sent to the engine 3 by both the first pump 25 and the second pump 26.

The low speed range is a range in which the engine speed is equal to or less than the above threshold. The low speed range is, for example, a speed range of the engine 3 when the engine 3 is sufficiently cooled by the cooling water supplied only by the second pump 26. The high speed range is a range in which the engine speed is greater than the threshold described above.

In the first preferred embodiment, when the engine speed is in the low speed range, the first pump 25 is not driven and the cooling water is sent to the engine 3 only by the second pump 26. As a result, overcooling of the engine 3 is suppressed. Further, since the first pump 25 is not driven, loss of driving force of the engine 3 is suppressed.

When the engine speed is in the high speed range, the cooling water is sent to the engine 3 by both the first pump 25 and the second pump 26. A positive displacement pump has low pump efficiency in a high speed range, but a sufficient amount of cooling water is supplied to the engine 3 by sending the cooling water to the engine 3 by both the first pump 25 and the second pump 26.

Figure 4:
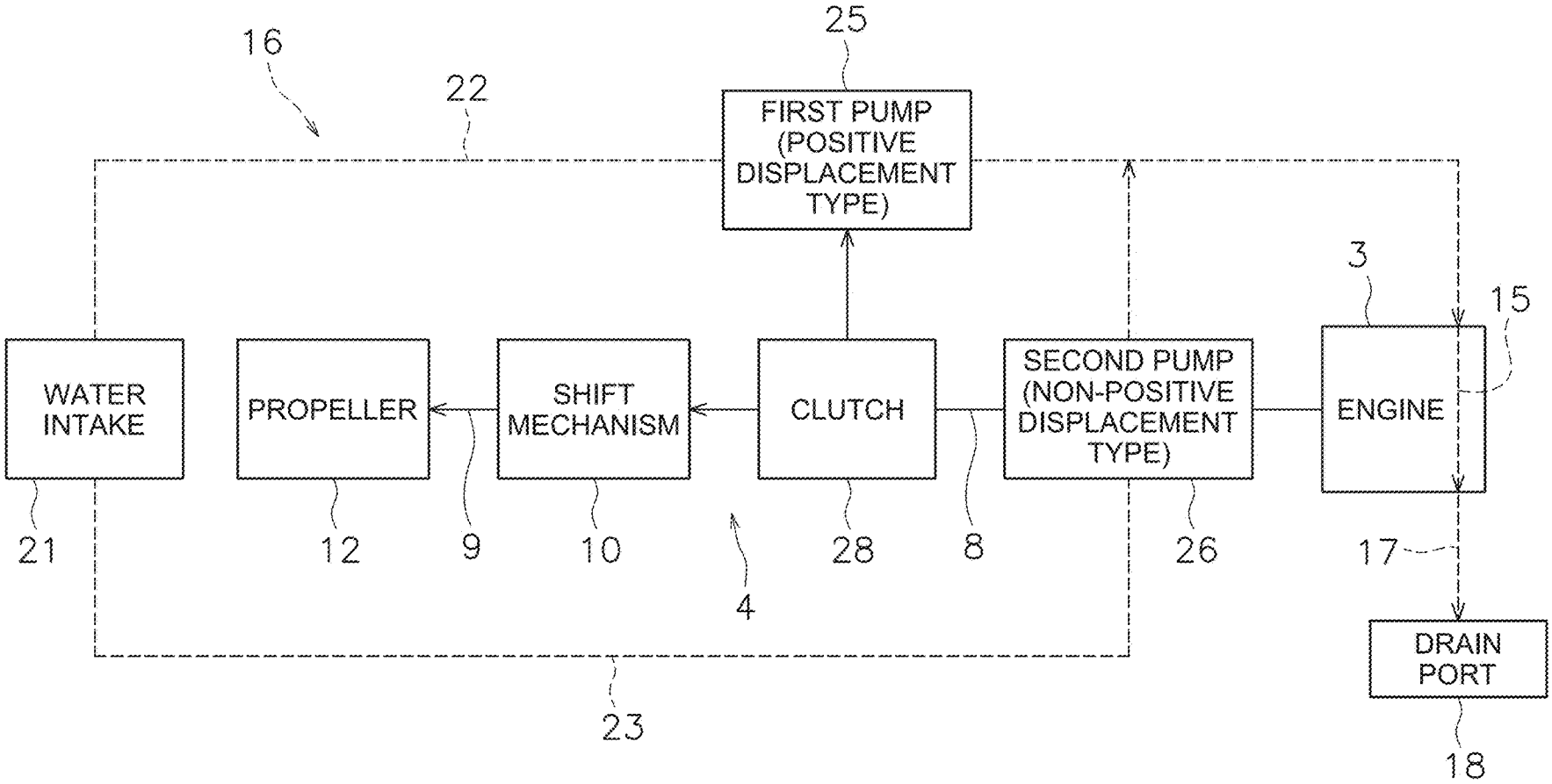
FIG. 4 is a block diagram showing the cooling system of an outboard motor according to a second preferred embodiment of the present invention.

FIG. 4 is a block diagram showing the cooling system and the drive system of the outboard motor 1 according to a second preferred embodiment of the present invention. The configurations of the cooling system and the drive system in the second preferred embodiment are the same as the configurations of the cooling system and the drive system in the first preferred embodiment. In the second preferred embodiment, the first pump 25 is a positive displacement pump and the second pump 26 is a non-positive displacement pump. The second pump 26 is, for example, a centrifugal pump. Alternatively, the second pump 26 may be another type of non-positive displacement pump, such as an axial pump. Other configurations of the outboard motor 1 according to the second preferred embodiment are the same as those of the outboard motor 1 according to the first preferred embodiment.

In the second preferred embodiment, when the engine speed is in the low speed range, the clutch 28 connects the first pump 25 and the transmission mechanism 4, and the first pump 25 and the second pump 26 are driven. Thus, the cooling water is sent to the engine 3 by both the first pump 25 and the second pump 26.

When the engine speed is in the high speed range, the clutch 28 disconnects the first pump 25 and the transmission mechanism 4, and the second pump 26 is driven. Thus, the first pump 25 is not driven, and the cooling water is sent to the engine 3 only by the second pump 26.

The low speed range is, for example, a speed range in which the pump efficiency of a non-positive displacement pump is low. The high speed range is, for example, a speed range in which the pump efficiency of a non-positive displacement pump is high. In the second preferred embodiment, the cooling water is sent to the engine 3 by both the first pump 25 and the second pump 26 when the engine speed is in the low speed range. Although the second pump 26, which is a non-positive displacement pump, has a low pump efficiency in the low speed range, an appropriate amount of cooling water is supplied to the engine 3 by driving the first pump 25 which is a positive displacement pump. Also, even if the second pump 26 is disposed at a position higher than the water surface, the first pump 25 supplies priming water for the second pump 26 to the second pump 26.

When the engine speed is in the high speed range, the first pump 25 is not driven and the cooling water is sent to the engine 3 only by the second pump 26. Although the first pump 25, which is a positive displacement pump, has a low pump efficiency in the high speed range, the first pump 25 is not driven, and the cooling water is sent to engine 3 by the second pump 26 which is a non-positive displacement pump and has a high pump efficiency in the high speed range. Thus, the loss of the driving force of the engine 3 is suppressed.

Figure 5:
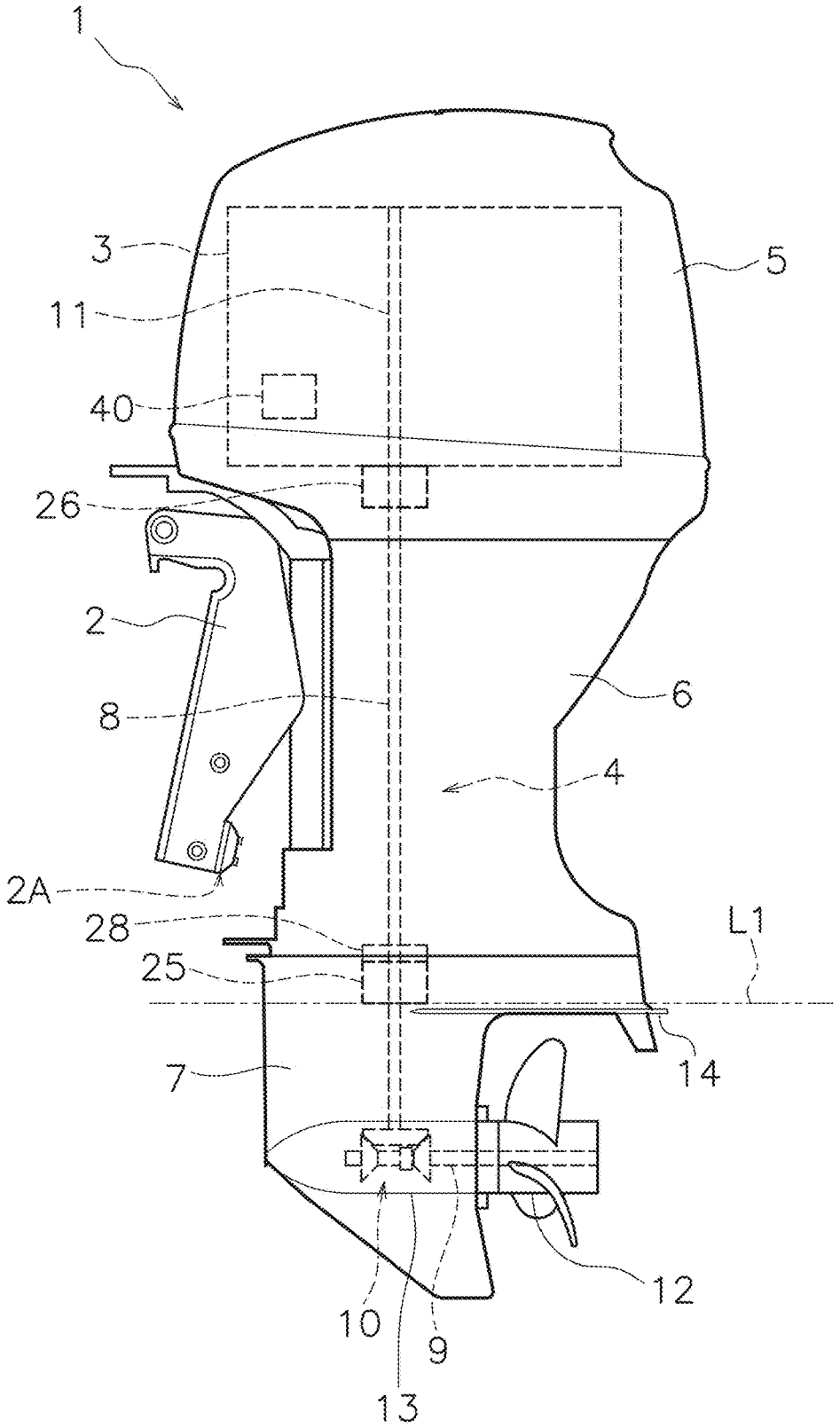
FIG. 5 is a diagram showing a first example of an arrangement of a first pump and a second pump.

FIGS. 5 to 18 are diagrams showing examples of an arrangement of the first pump 25 and the second pump 26 in the first preferred embodiment and the second preferred embodiment. FIG. 5 shows a first example of the arrangement of the first pump 25 and the second pump 26. As shown in FIG. 5, in the first example, the first pump 25 is disposed above the cavitation plate 14. The first pump 25 is disposed above the waterline L1. The second pump 26 is disposed above a lower end 2A of the bracket 2. The second pump 26 is disposed directly below the crankshaft 11.

Figure 6:
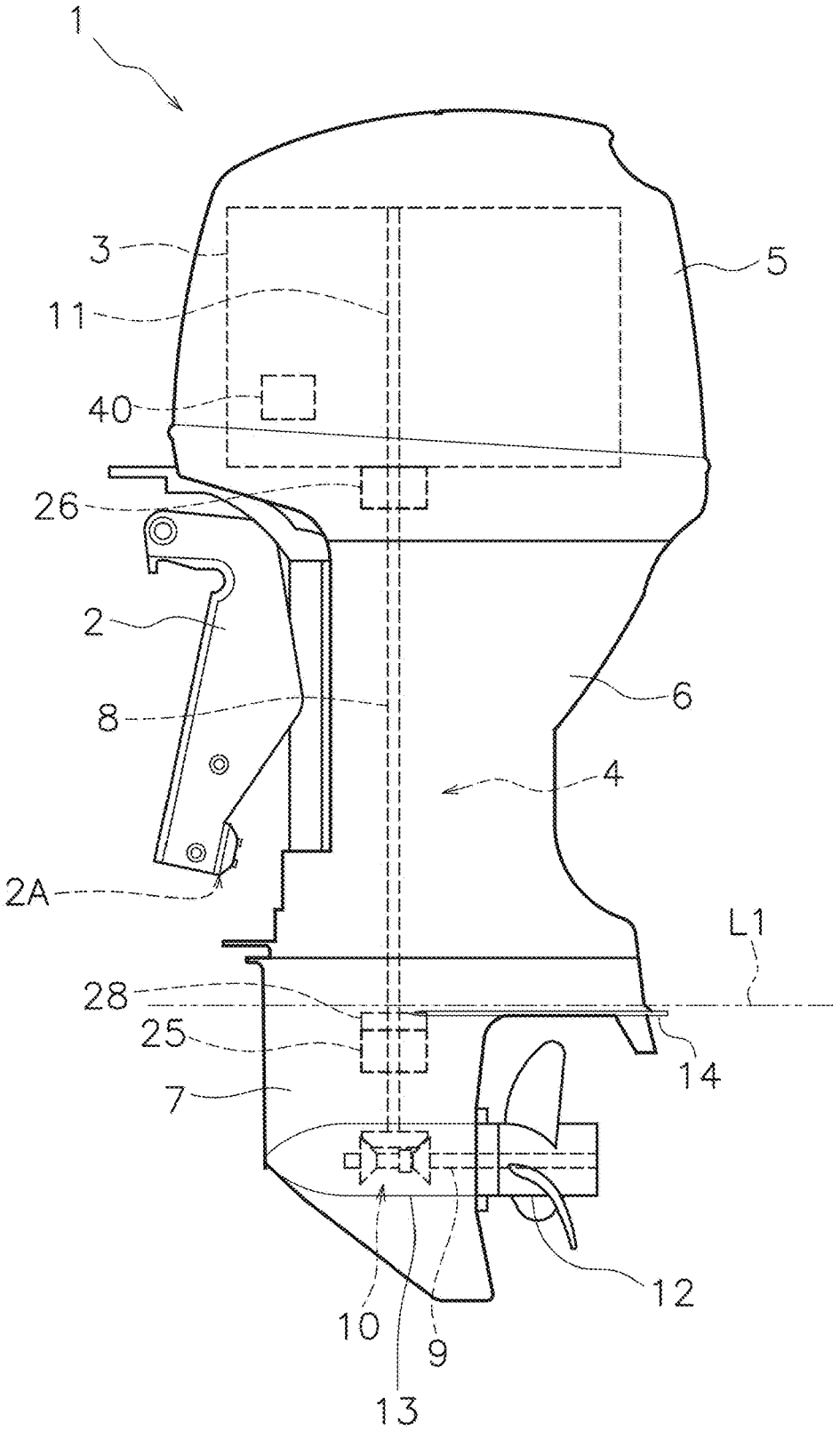
FIG. 6 is a diagram showing a second example of the arrangement of the first pump and the second pump.

FIG. 6 shows a second example of the arrangement of the first pump 25 and the second pump 26. As shown in FIG. 6, in the second example, the first pump 25 is disposed below the cavitation plate 14. The second pump 26 is disposed directly below the crankshaft 11.

Figure 7:
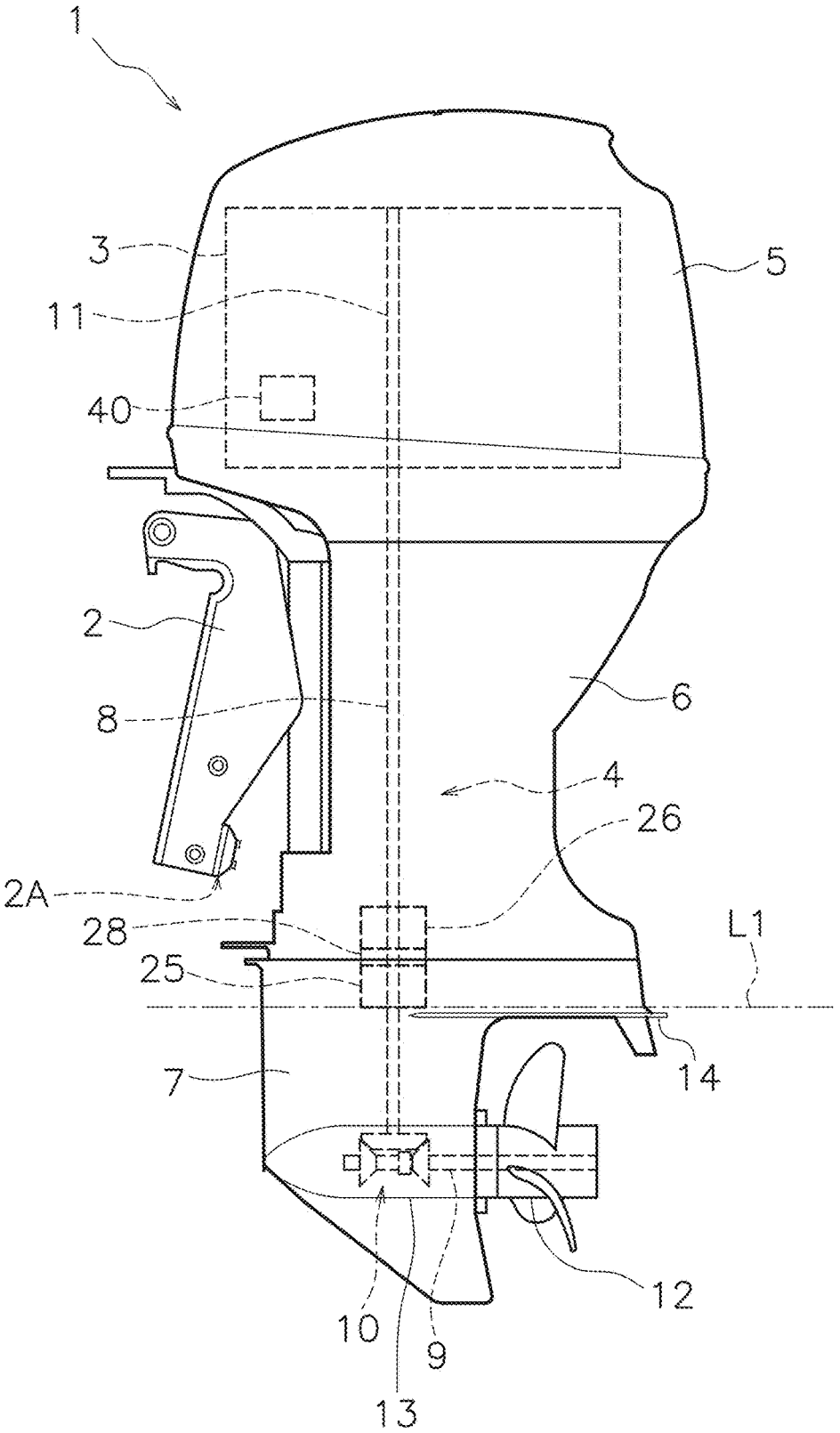
FIG. 7 is a diagram showing a third example of the arrangement of the first pump and the second pump.

FIG. 7 shows a third example of the arrangement of the first pump 25 and the second pump 26. As shown in FIG. 7, in the third example, the first pump 25 and the second pump 26 are disposed above the cavitation plate 14.

Figure 8:
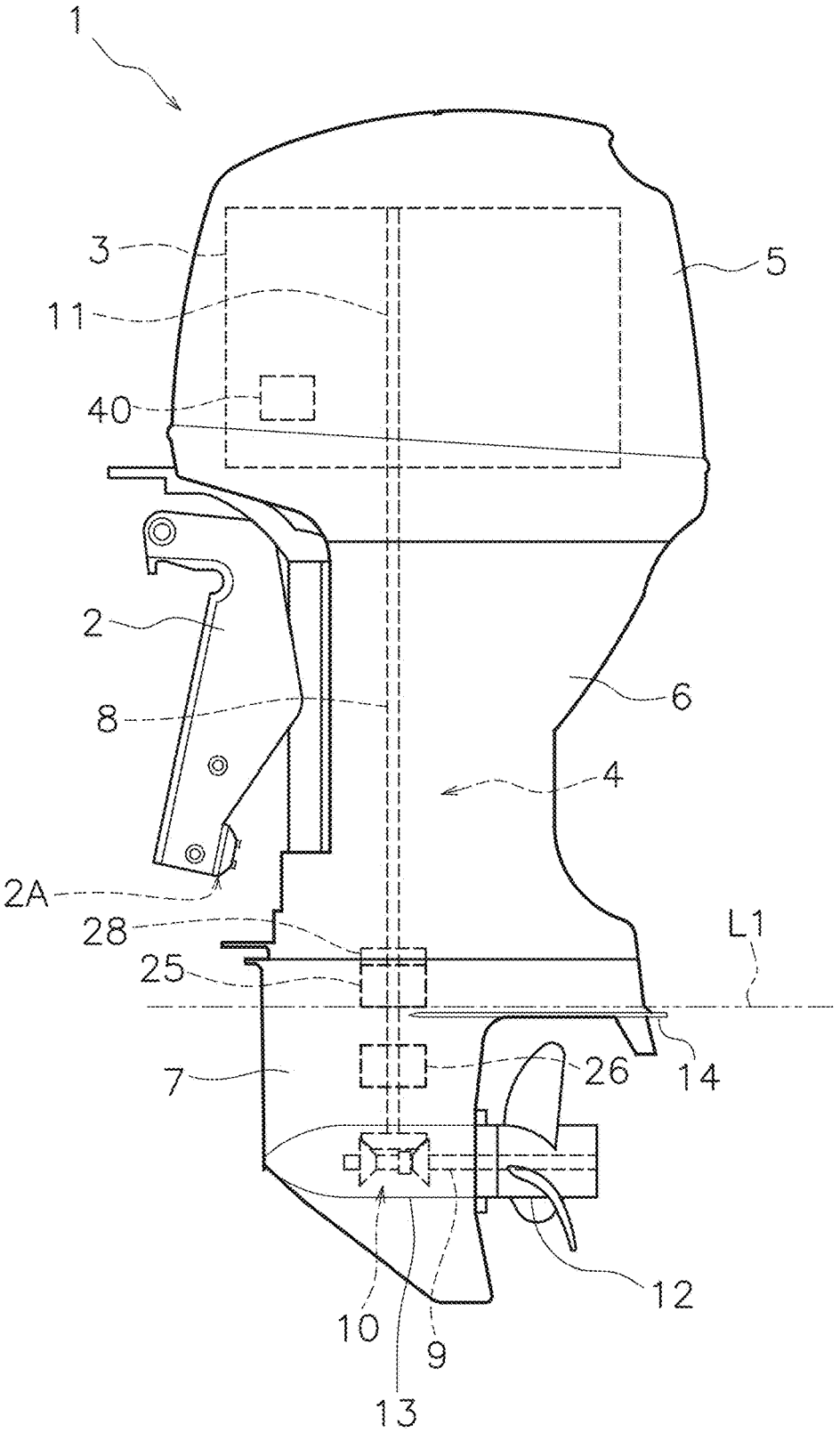
FIG. 8 is a diagram showing a fourth example of the arrangement of the first pump and the second pump.

FIG. 8 shows a fourth example of the arrangement of the first pump 25 and the second pump 26. As shown in FIG. 8, in the fourth example, the first pump 25 is disposed above the cavitation plate 14. The second pump 26 is disposed below the cavitation plate 14.

Figure 9:
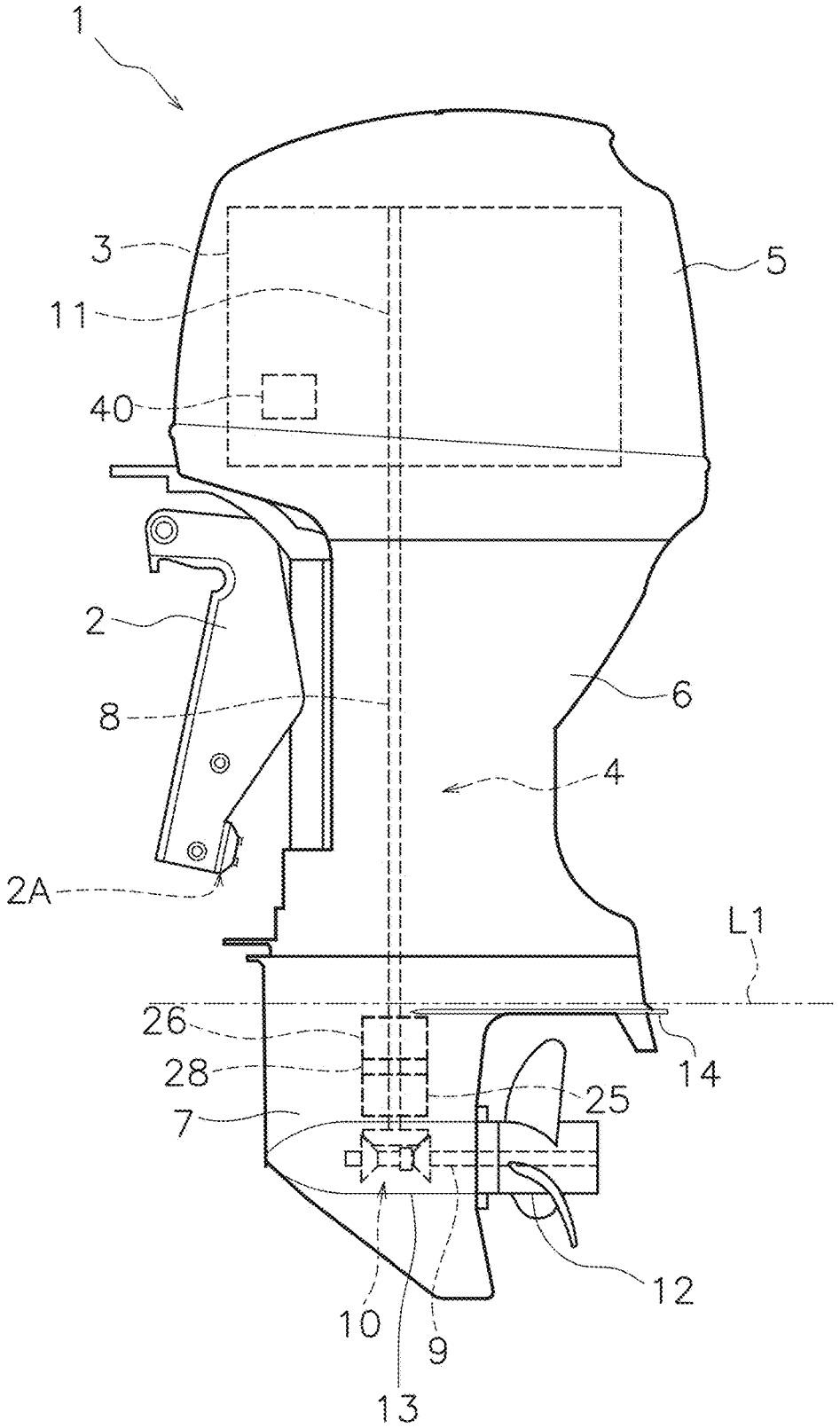
FIG. 9 is a diagram showing a fifth example of the arrangement of the first pump and the second pump.

FIG. 9 shows a fifth example of the arrangement of the first pump 25 and the second pump 26. As shown in FIG. 9, in the fifth example, the first pump 25 and the second pump 26 are disposed below the cavitation plate 14.

Figure 10:
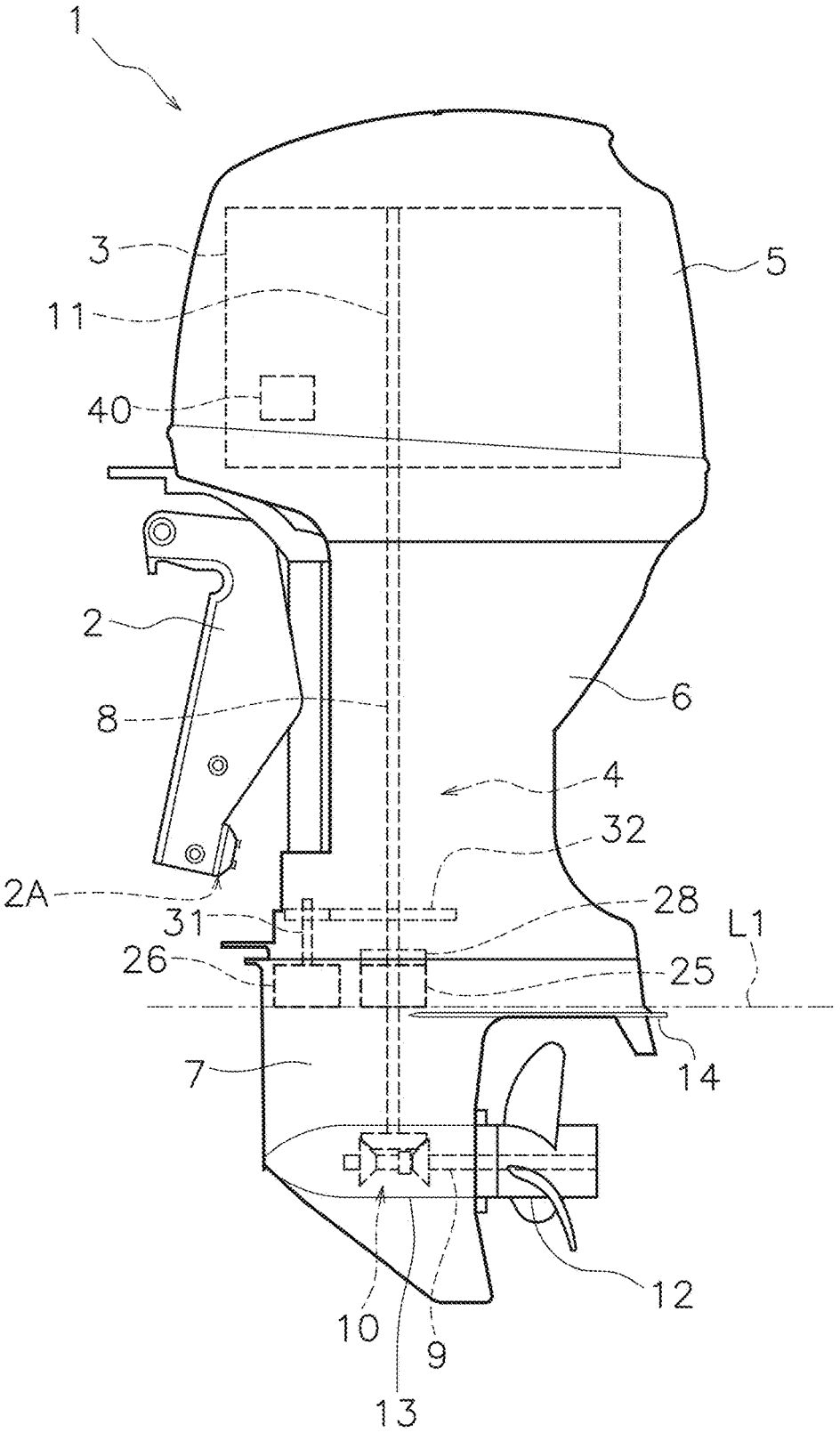
FIG. 10 is a diagram showing a sixth example of the arrangement of the first pump and the second pump.

FIG. 10 shows a sixth example of the arrangement of the first pump 25 and the second pump 26. As shown in FIG. 10, the transmission mechanism 4 includes an intermediate shaft 31 and a link mechanism 32 in the sixth example. The intermediate shaft 31 is offset with respect to the drive shaft 8. The intermediate shaft 31 is connected to the drive shaft 8 via the link mechanism 32 such as gears or a belt. The second pump 26 is coaxial with the intermediate shaft 31. The second pump 26 is connected to the intermediate shaft 31. The first pump 25 and the second pump 26 are disposed above the cavitation plate 14.

Figure 11:
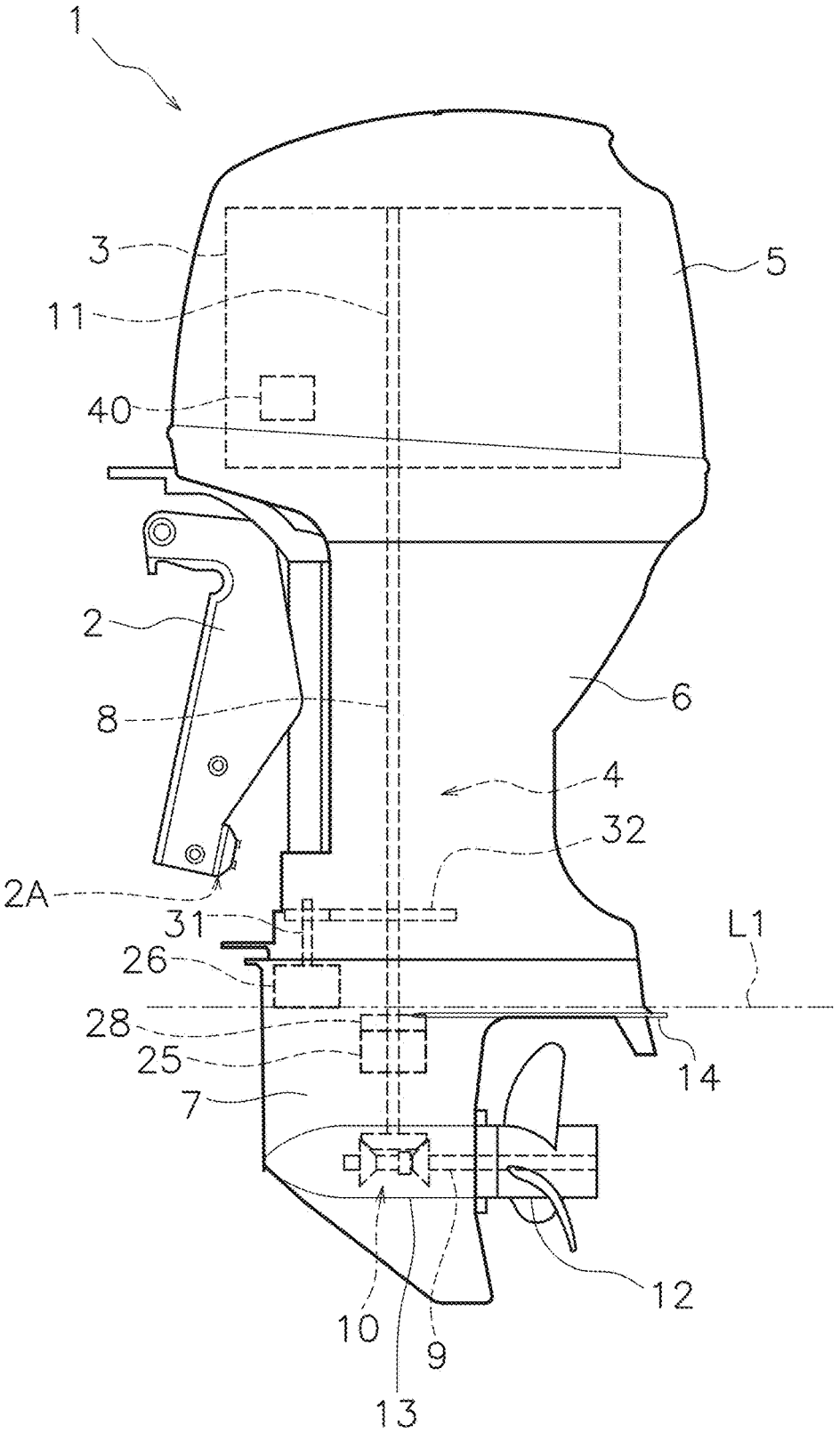
FIG. 11 is a diagram showing a seventh example of the arrangement of the first pump and the second pump.

FIG. 11 shows a seventh example of the arrangement of the first pump 25 and the second pump 26. As shown in FIG. 11, in the seventh example, the second pump 26 is connected to the intermediate shaft 31 as in the sixth example. The first pump 25 is disposed below the cavitation plate 14. The second pump 26 is disposed above the cavitation plate 14.

Figure 12:
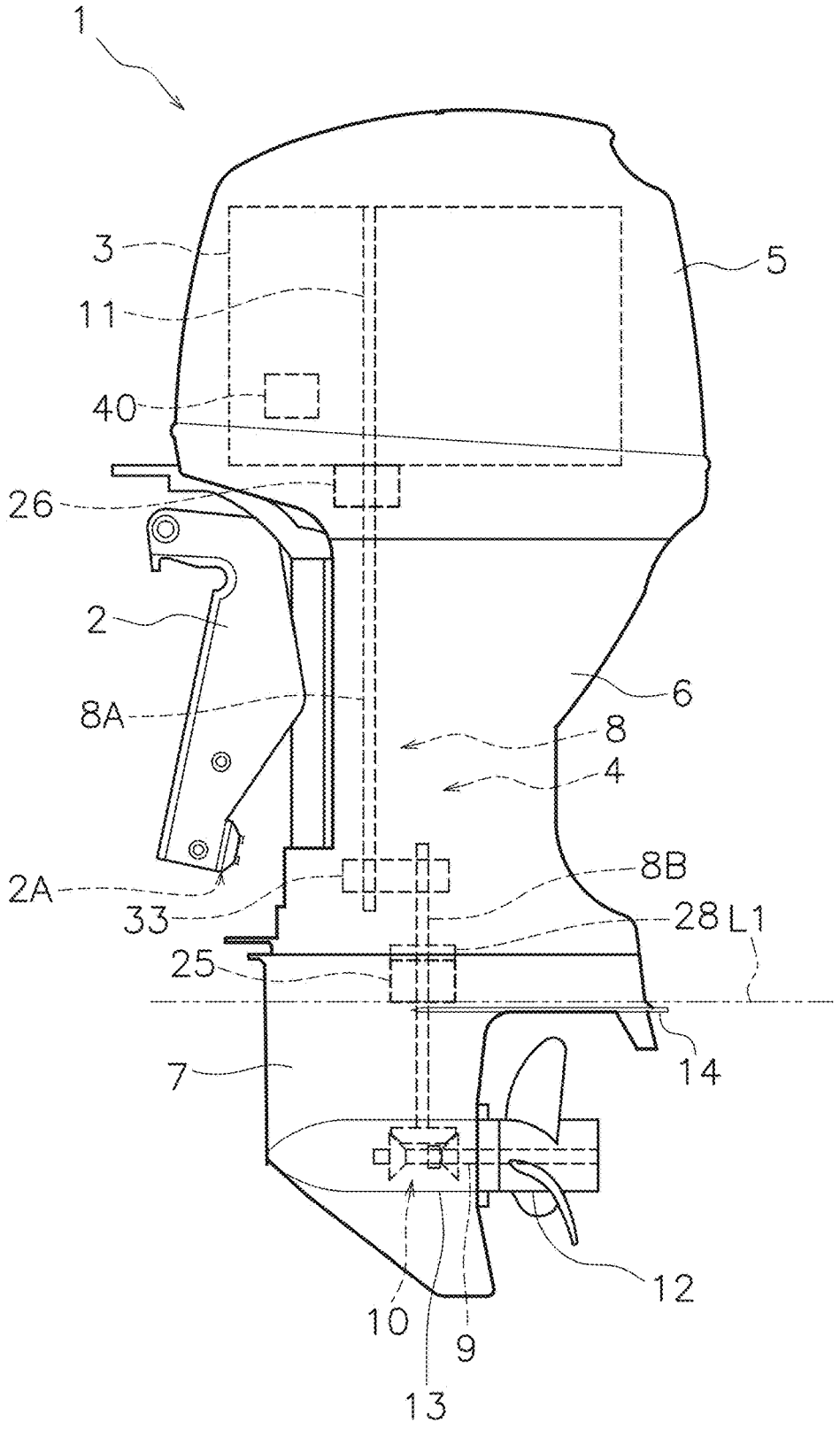
FIG. 12 is a diagram showing an eighth example of the arrangement of the first pump and the second pump.

FIG. 12 shows an eighth example of the arrangement of the first pump 25 and the second pump 26. As shown in FIG. 12, in the eighth example, the drive shaft 8 includes a first drive shaft 8A and a second drive shaft 8B. The first drive shaft 8A is connected to the crankshaft 11. The second drive shaft 8B is connected to the propeller shaft 9 via the shift mechanism 10. The first drive shaft 8A and the second drive shaft 8B are offset with respect to each other. The transmission mechanism 4 includes a link mechanism 33. The second drive shaft 8B is connected to the first drive shaft 8A via the link mechanism 33 such as gears or a belt. The first pump 25 is connected to the second drive shaft 8B. In the eighth example, the arrangement of the first pump 25 and the second pump 26 is the same as in the first example.

Figure 13:
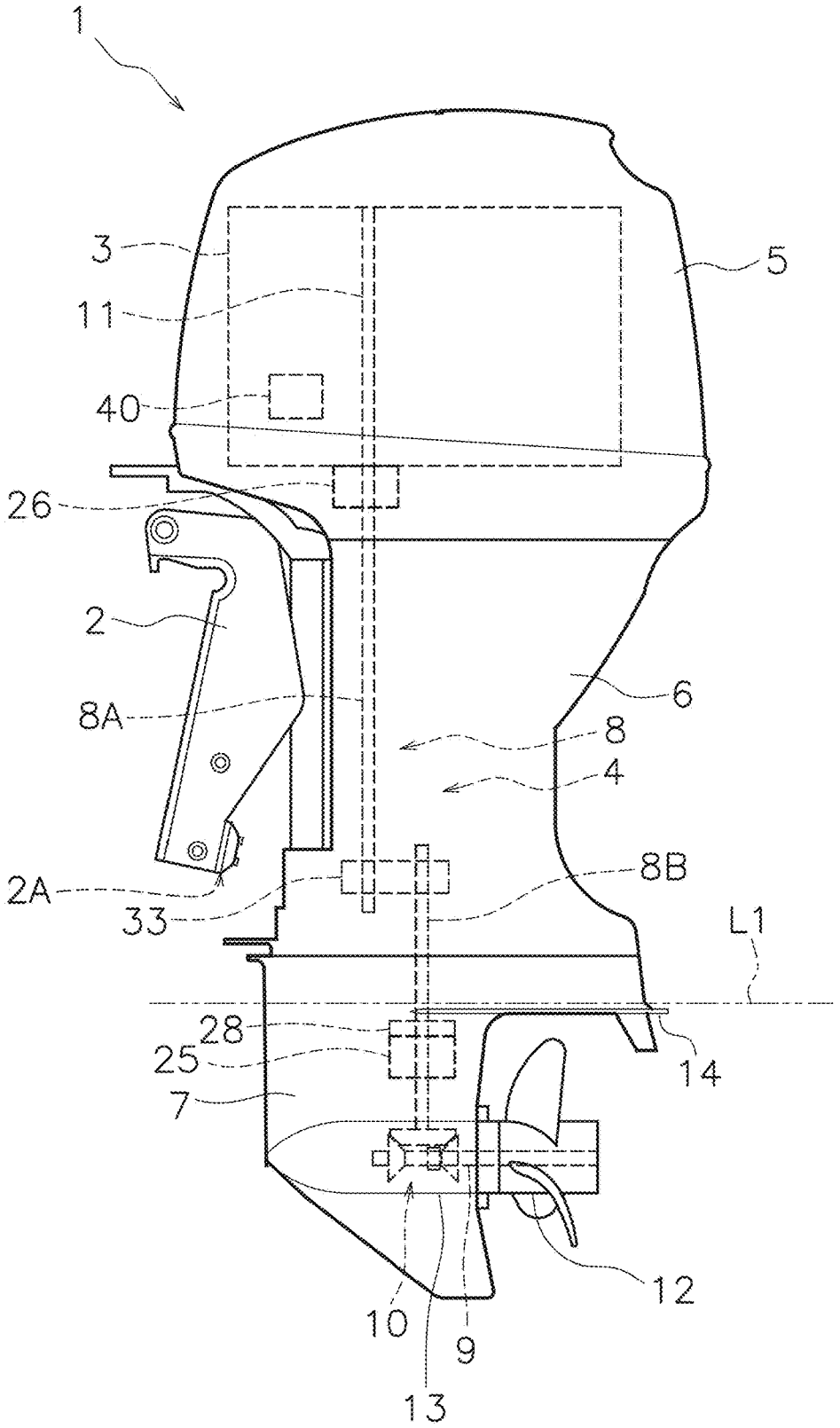
FIG. 13 is a diagram showing a ninth example of the arrangement of the first pump and the second pump.

FIG. 13 shows a ninth example of the arrangement of the first pump 25 and the second pump 26. As shown in FIG. 13, in the ninth example, similarly to the eighth example, the first pump 25 is connected to the second drive shaft 8B. The second drive shaft 8B is connected via the link mechanism 33 to the first drive shaft 8A. In the ninth example, the arrangement of the first pump 25 and the second pump 26 is the same as in the second example.

Figure 14:
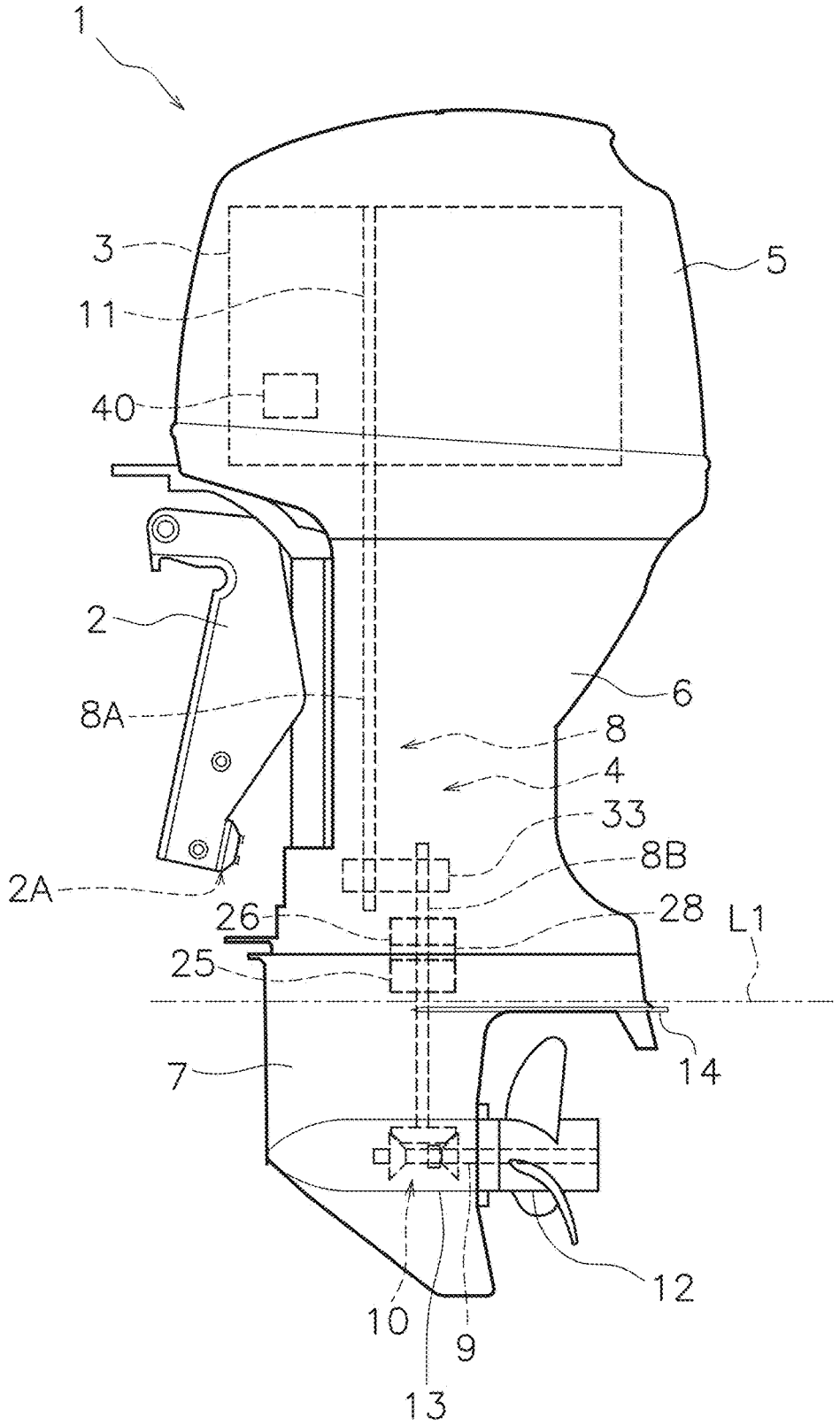
FIG. 14 is a diagram showing a tenth example of the arrangement of the first pump and the second pump.

FIG. 14 shows a tenth example of the arrangement of the first pump 25 and the second pump 26. As shown in FIG. 14, in the tenth example, the first pump 25 and the second pump 26 are connected to the second drive shaft 8B. In the tenth example, the arrangement of the first pump 25 and the second pump 26 is the same as in the third example.

Figure 15:
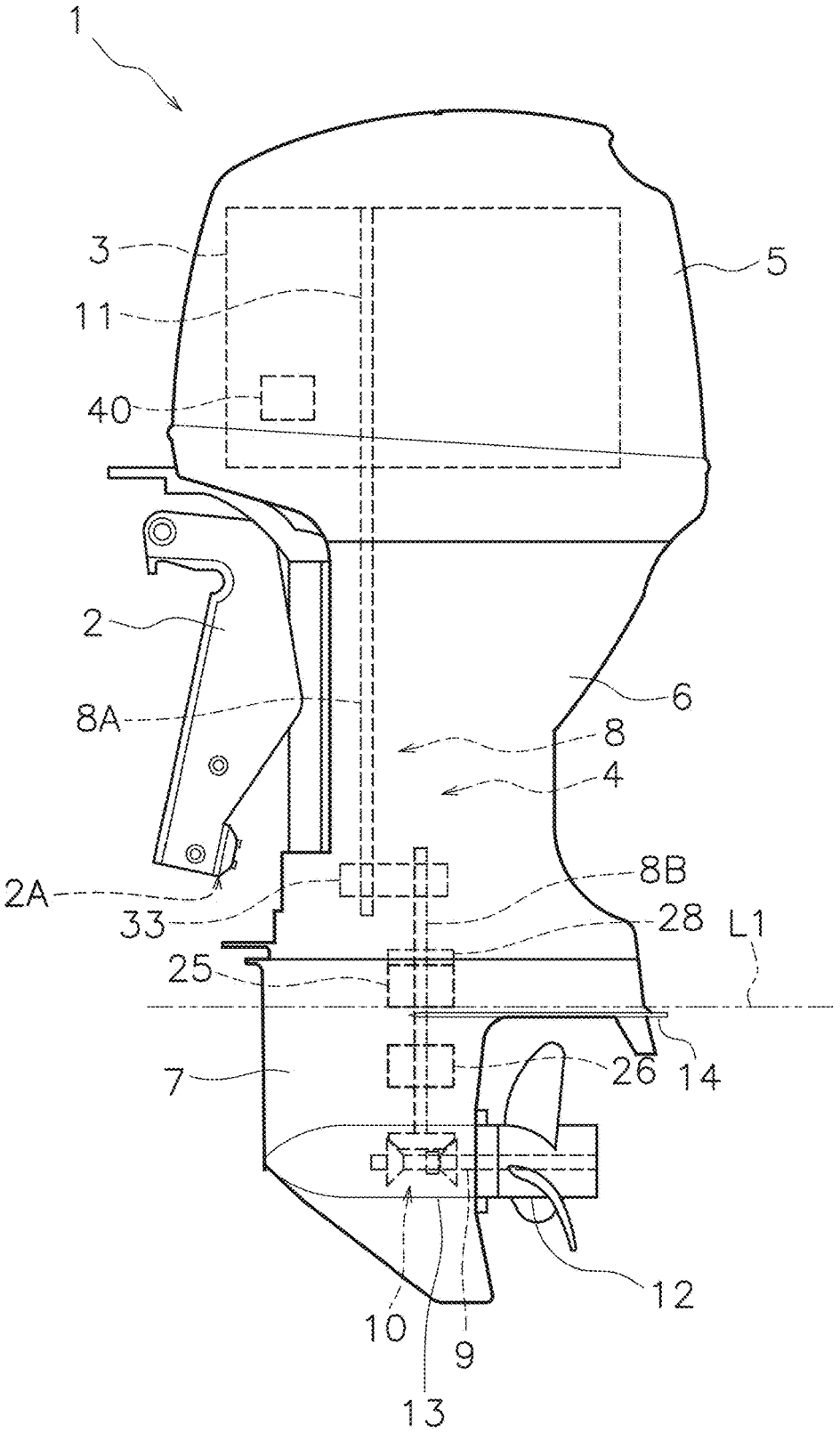
FIG. 15 is a diagram showing an eleventh example of the arrangement of the first pump and the second pump.

FIG. 15 shows an eleventh example of the arrangement of the first pump 25 and the second pump 26. As shown in FIG. 15, in the eleventh example, the first pump 25 and the second pump 26 are connected to the second drive shaft 8B. In the eleventh example, the arrangement of the first pump 25 and the second pump 26 is the same as in the fourth example.

Figure 16:
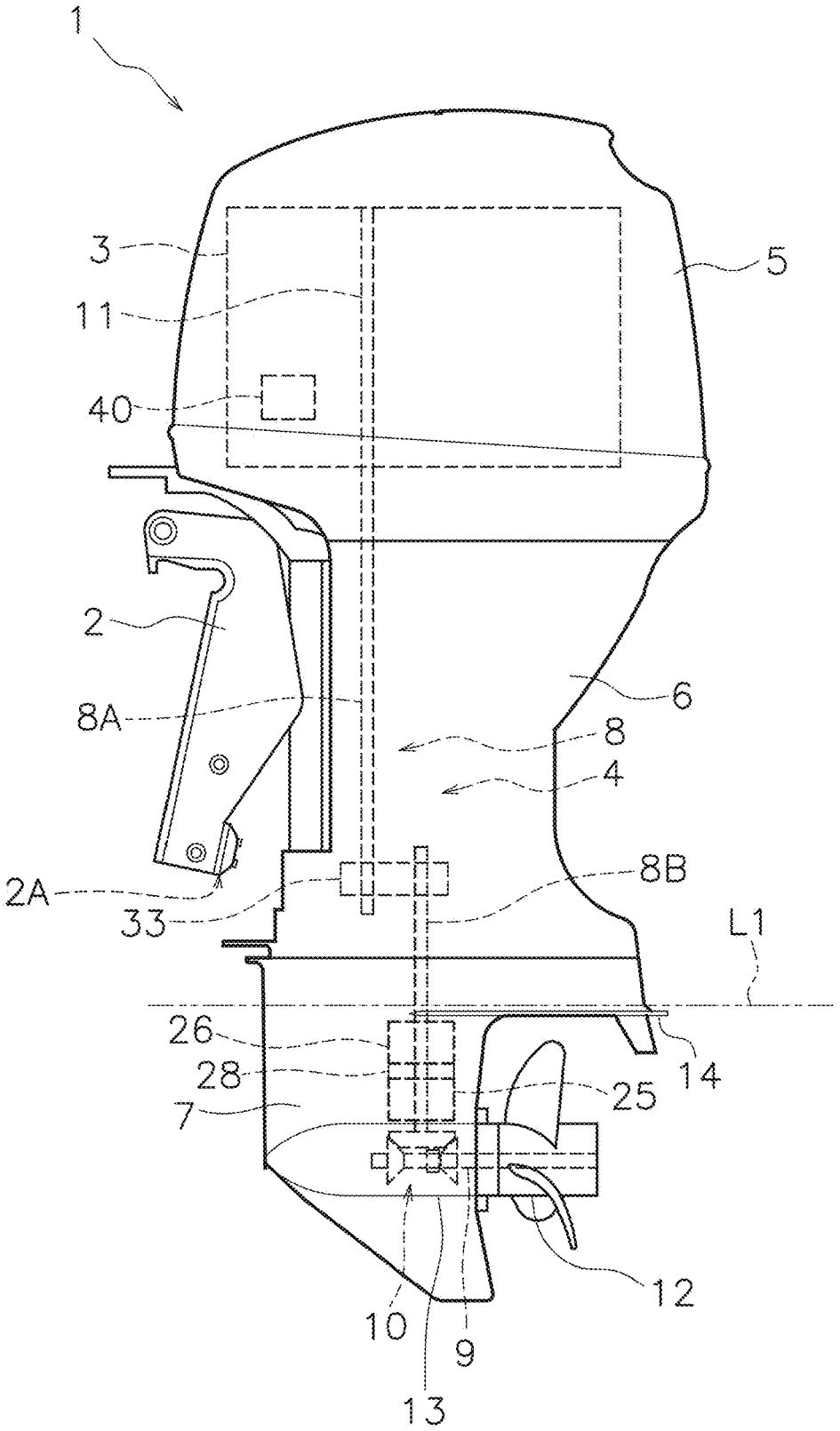
FIG. 16 is a diagram showing a twelfth example of the arrangement of the first pump and the second pump.

FIG. 16 shows a twelfth example of the arrangement of the first pump 25 and the second pump 26. As shown in FIG. 16, in the twelfth example, the first pump 25 and the second pump 26 are connected to the second drive shaft 8B. In the twelfth example, the arrangement of the first pump 25 and the second pump 26 is the same as in the fifth example.

Figure 17:
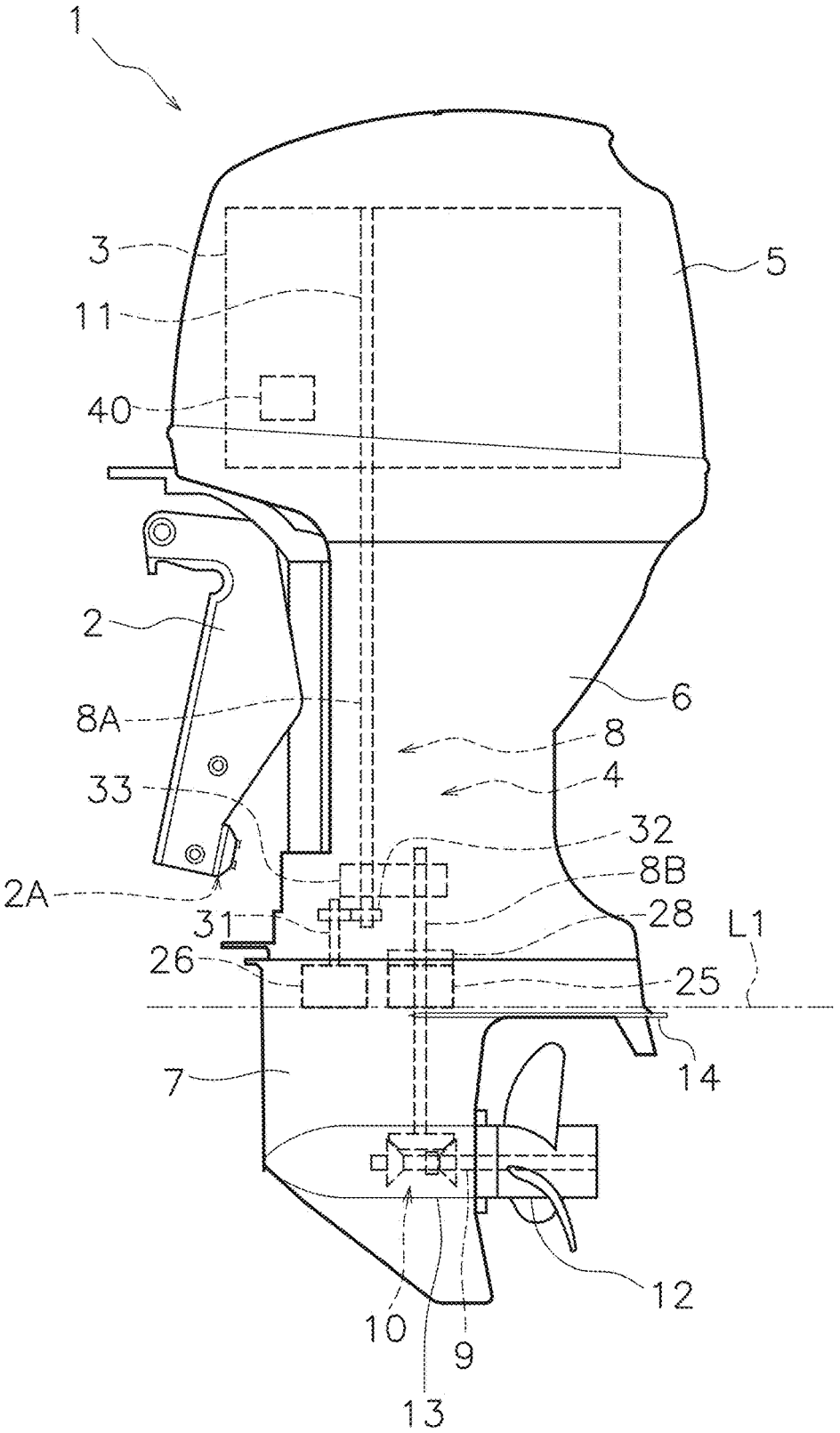
FIG. 17 is a diagram showing a thirteenth example of the arrangement of the first pump and the second pump.

FIG. 17 shows a thirteenth example of the arrangement of the first pump 25 and the second pump 26. As shown in FIG. 17, in the thirteenth example, the first pump 25 is connected to the second drive shaft 8B. The second pump 26 is connected via the intermediate shaft 31 to the first drive shaft 8A. In the thirteenth example, the arrangement of the first pump 25 and the second pump 26 is the same as in the sixth example.

Figure 18:
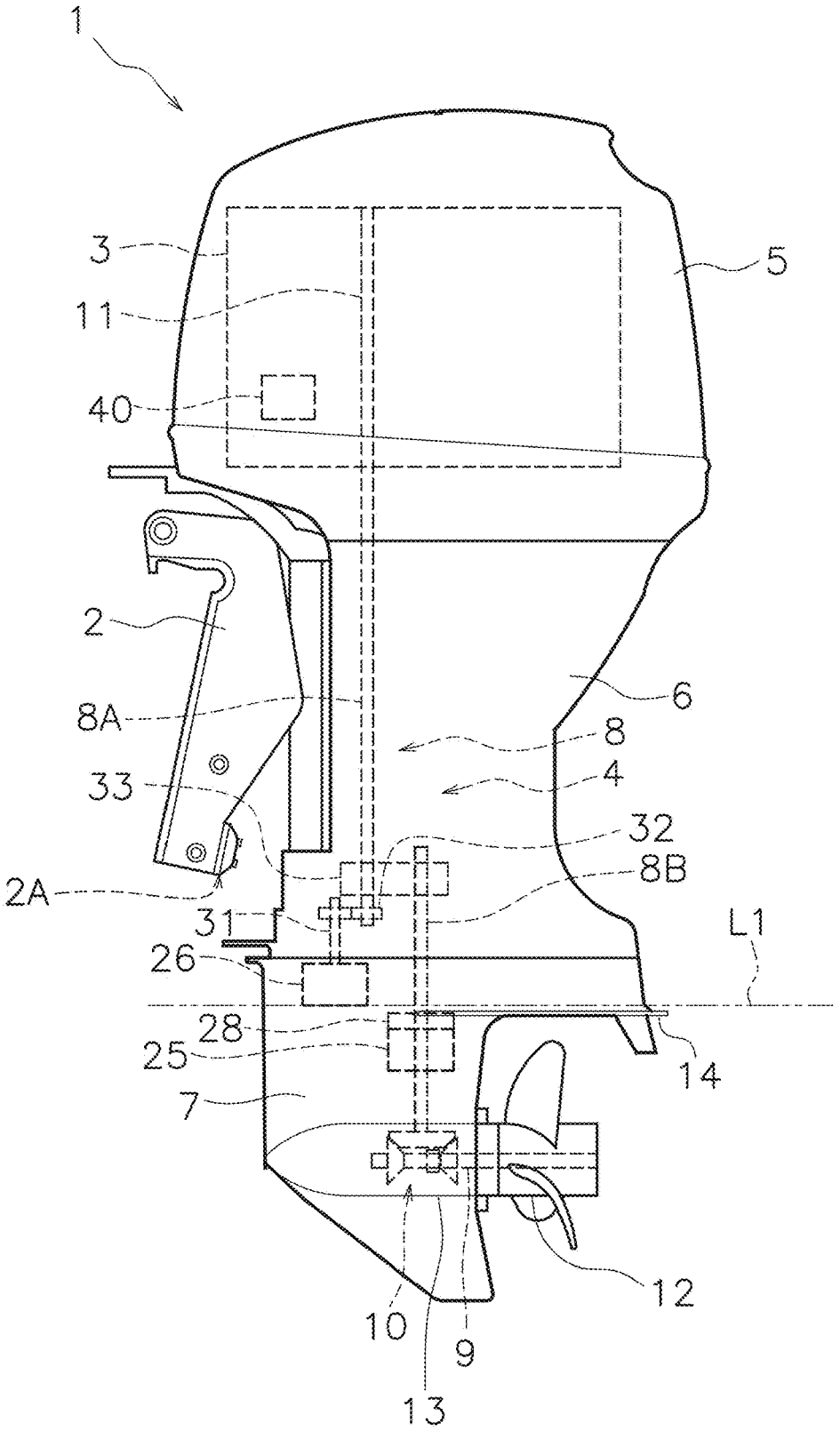
FIG. 18 is a diagram showing a fourteenth example of the arrangement of the first pump and the second pump.

FIG. 18 shows a fourteenth example of the arrangement of the first pump 25 and the second pump 26. As shown in FIG. 18, in the fourteenth example, the first pump 25 is connected to the second drive shaft 8B. The second pump 26 is connected via the intermediate shaft 31 to the first drive shaft 8A. In the fourteenth example, the arrangement of the first pump 25 and the second pump 26 is the same as in the seventh example.

Figure 19:
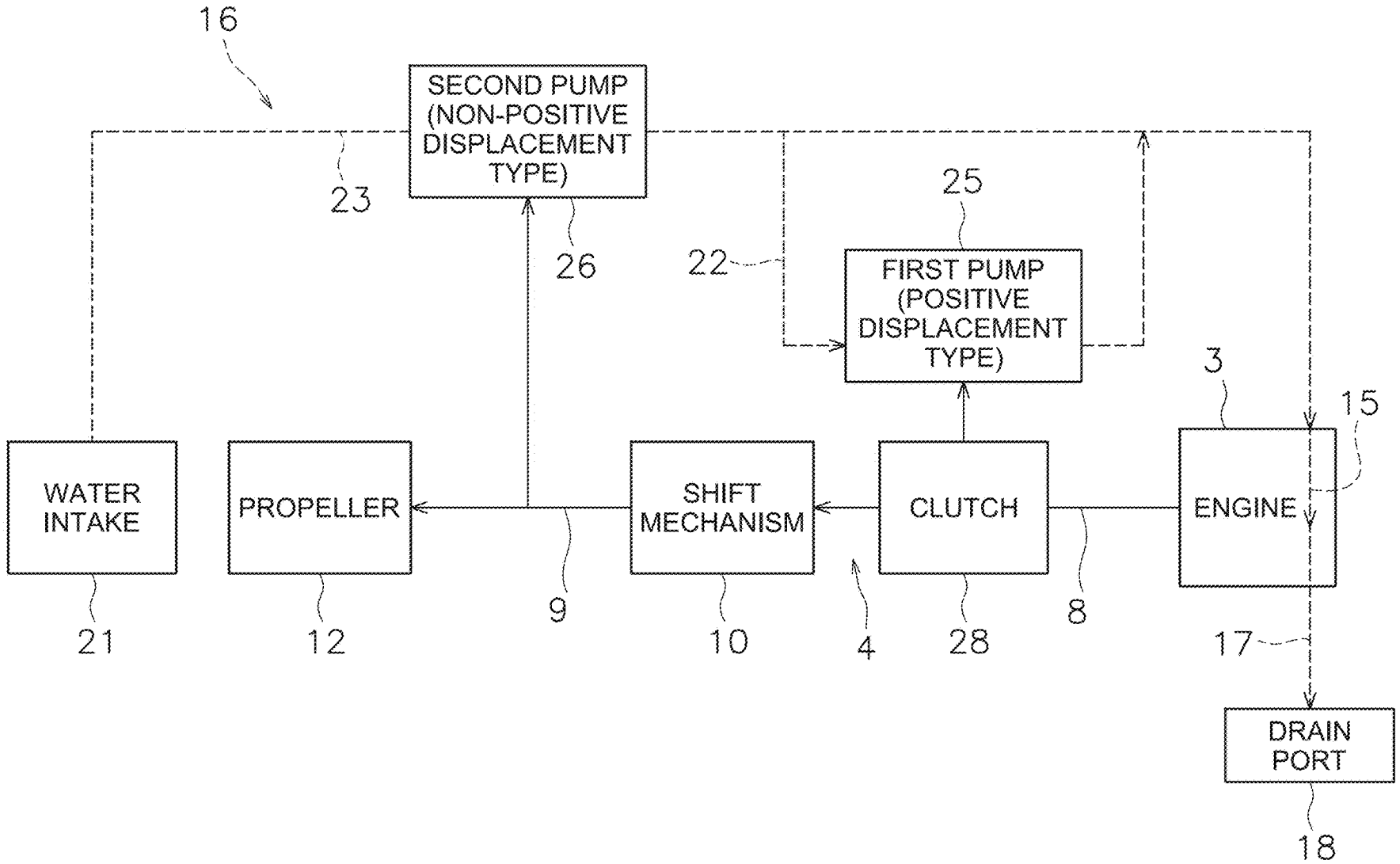
FIG. 19 is a block diagram showing a cooling system of an outboard motor according to a third preferred embodiment of the present invention.

FIG. 19 is a block diagram showing the cooling system and the drive system of the outboard motor 1 according to a third preferred embodiment of the present invention. As shown in FIG. 19, in the third preferred embodiment, the first pump 25 is connected to the drive shaft 8 or the crankshaft 11 via the clutch 28. The second pump 26 is connected to the propeller shaft 9. The first pump 25 is a positive displacement pump. The second pump 26 is a non-positive displacement pump. Other configurations of the outboard motor 1 according to the third preferred embodiment are the same as those of the outboard motor 1 according to the first preferred embodiment.

When the clutch 28 is in the engaged state, the driving force from the engine 3 is transmitted to the first pump 25 via the transmission mechanism 4 and the clutch 28. Thus, the first pump 25 is driven by the driving force of the engine 3 to send the cooling water to the engine 3 through the cooling water passage 16. When the clutch 28 is in the disengaged state, the driving force from the engine 3 is not transmitted to the first pump 25 and the first pump 25 is not driven.

The second pump 26 is always connected to the propeller shaft 9. Therefore, when the engine 3 is running and the shift mechanism 10 is in the driving state, the driving force from the engine 3 is always transmitted to the second pump 26. Thus, the second pump 26 is driven by the driving force of the engine 3 to send the cooling water to the engine 3 through the cooling water passage 16.

However, even if the engine 3 is driven, the driving force from the engine 3 is not transmitted to the propeller shaft 9 when the shift mechanism 10 is in the neutral state. Therefore, when the shift mechanism 10 is in the neutral state, even if the engine 3 is driven, the driving force from the engine 3 is not transmitted to the second pump 26 and the second pump 26 is not driven.

In the third preferred embodiment, the clutch 28 connects the first pump 25 and the drive shaft 8 and the first pump 25 and the second pump 26 are driven when the shift mechanism 10 is in the driving state and the engine speed is in the low speed range. Thus, the cooling water is sent to the engine 3 by both the first pump 25 and the second pump 26.

When the shift mechanism 10 is in the driving state and the engine speed is in the high speed range, the clutch 28 disconnects the first pump 25 and the drive shaft 8, and the second pump 26 is driven. Thus, the first pump 25 is not driven, and the cooling water is sent to the engine 3 only by the second pump 26.

When the shift mechanism 10 is in the neutral state, the clutch 28 connects the first pump 25 and the drive shaft 8 and the first pump 25 is driven regardless of the engine speed. Thus, the second pump 26 is not driven, and the cooling water is sent to the engine 3 only by the first pump 25.

In the third preferred embodiment, when the shift mechanism 10 is in the driving state, a state in which the cooling water is supplied to the engine 3 by both the first pump 25 and the second pump 26 and a state in which the cooling water is supplied to the engine 3 only by the second pump 26 are switched according to the engine speed. Thus, an appropriate amount of cooling water is supplied to the engine 3 to cool the engine 3. Moreover, the loss of the driving force of the engine 3 is suppressed.

When the shift mechanism 10 is in the neutral state, no driving force is transmitted to the propeller shaft 9, but cooling water is sent to the engine 3 by the first pump 25. Thus, for example, even when the engine 3 is idling, an appropriate amount of cooling water is supplied to the engine 3 to cool the engine 3.

FIGS. 20 to 27 are diagrams showing examples of the arrangement of the first pump 25 and the second pump 26 in the third preferred embodiment. As shown in FIGS. 20 to 27, in the examples of the arrangement of the first pump 25 and the second pump 26 in the third preferred embodiment, the second pump 26 is connected to the propeller shaft 9 and is disposed in the torpedo portion 13.

Figure 20:
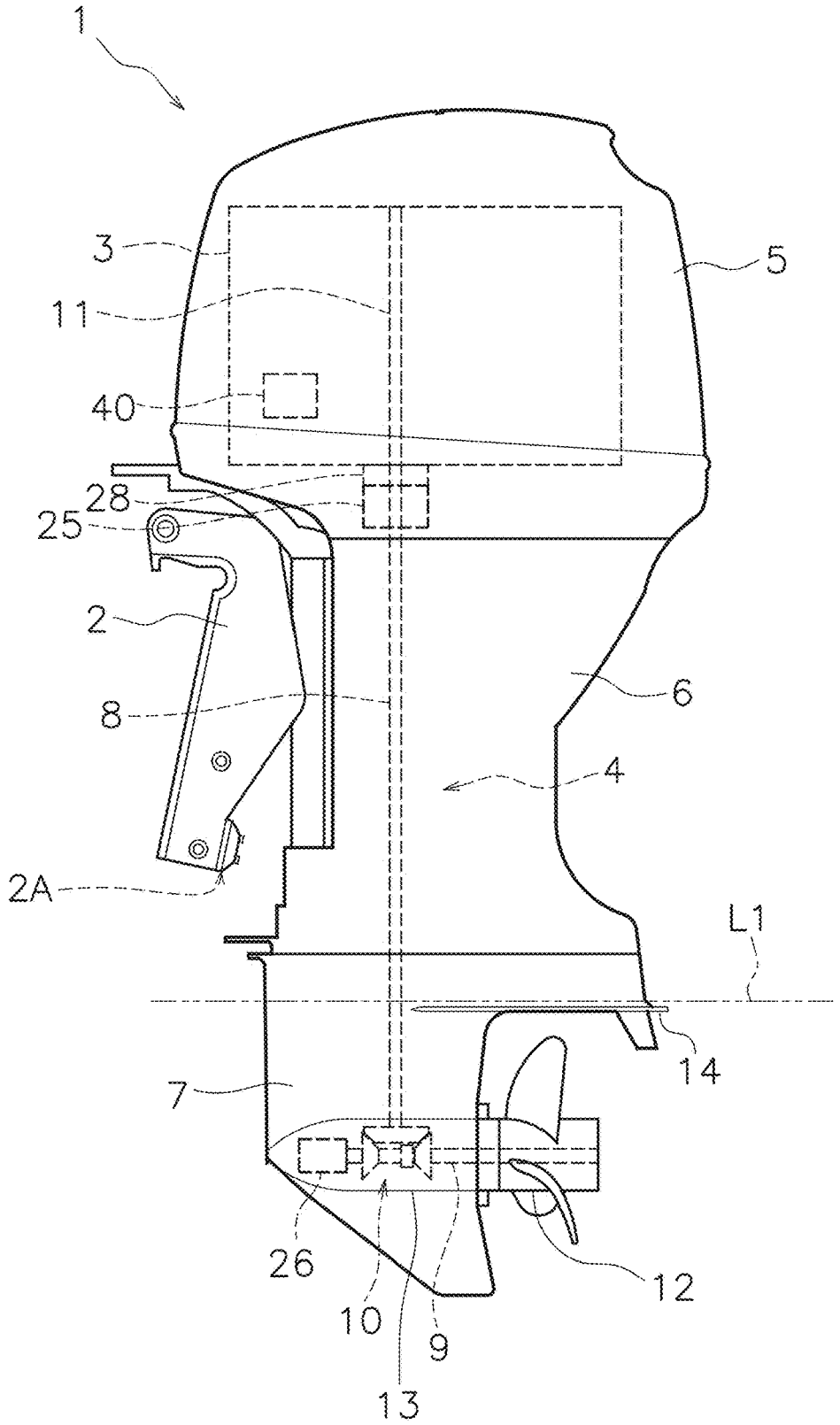
FIG. 20 is a diagram showing a fifteenth example of the arrangement of the first pump and the second pump.

FIG. 20 shows a fifteenth example of the arrangement of the first pump 25 and the second pump 26. As shown in FIG. 20, in the fifteenth example, the first pump 25 is disposed directly below the crankshaft 11.

Figure 21:
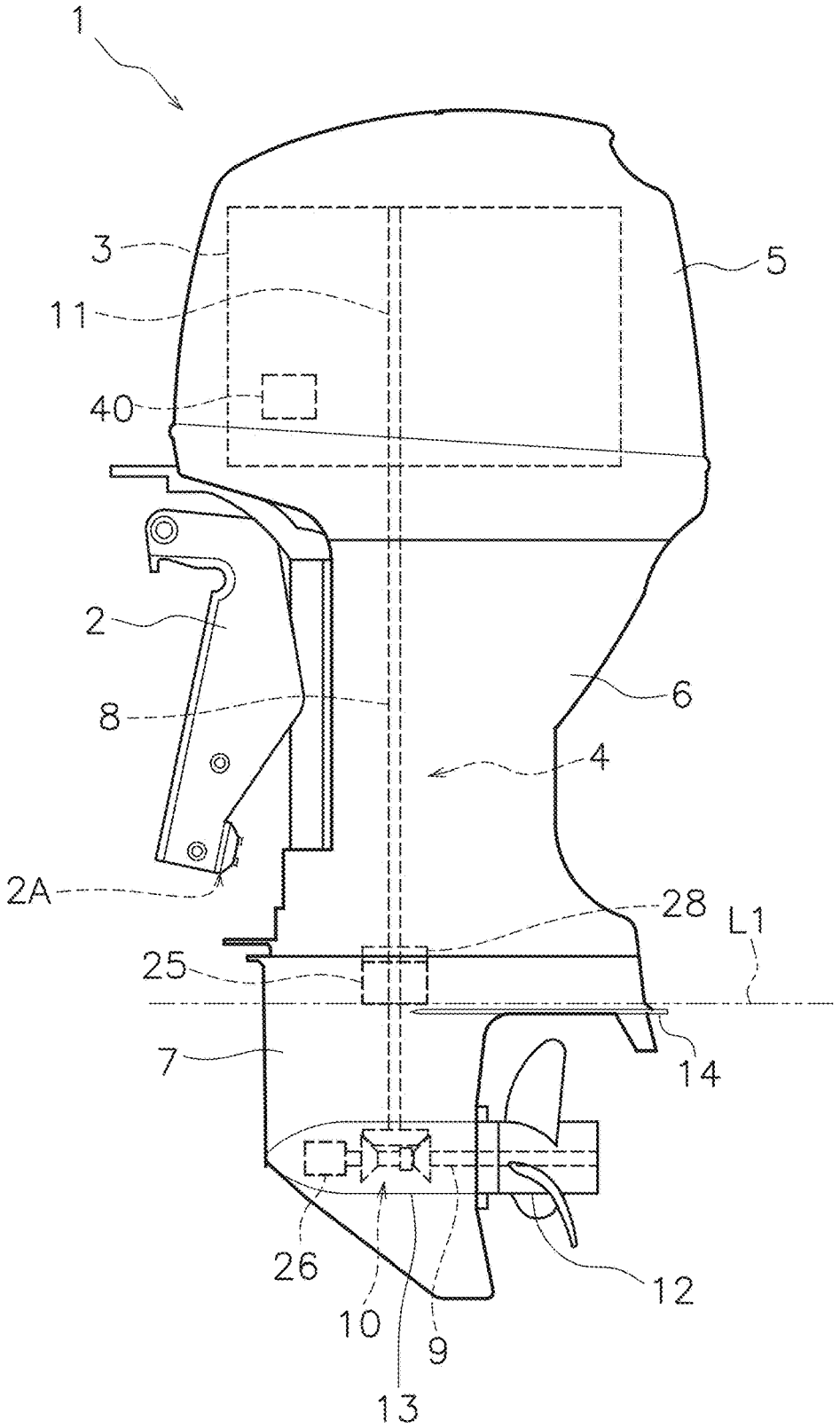
FIG. 21 is a diagram showing a sixteenth example of the arrangement of the first pump and the second pump.

FIG. 21 shows a sixteenth example of the arrangement of the first pump 25 and the second pump 26. As shown in FIG. 21, in the sixteenth example, the first pump 25 is disposed above the cavitation plate 14.

Figure 22:
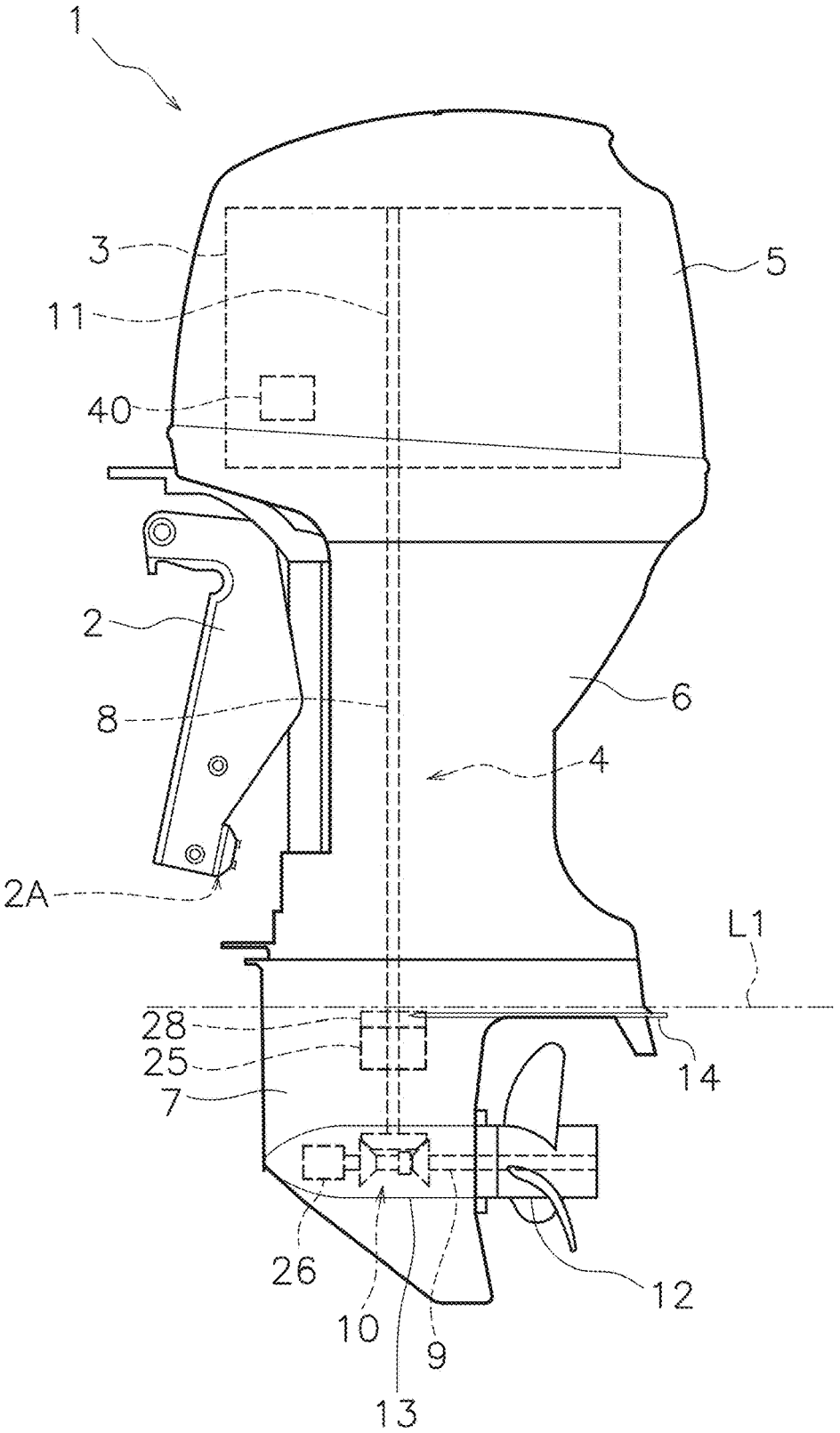
FIG. 22 is a diagram showing a seventeenth example of the arrangement of the first pump and the second pump.

FIG. 22 shows a seventeenth example of the arrangement of the first pump 25 and the second pump 26. As shown in FIG. 22, in the seventeenth example, the first pump 25 is disposed below the cavitation plate 14.

Figure 23:
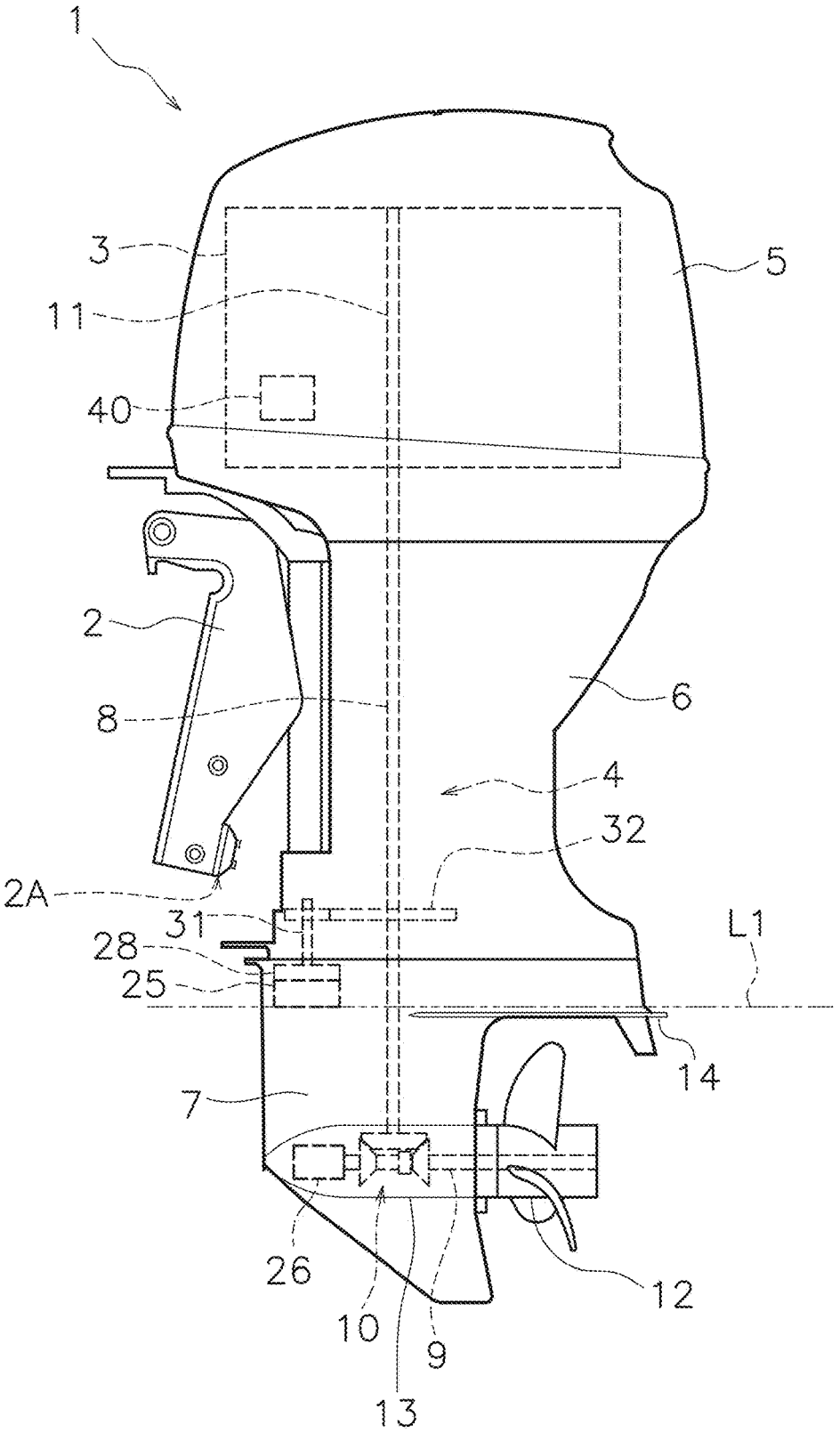
FIG. 23 is a diagram showing an eighteenth example of the arrangement of the first pump and the second pump.

FIG. 23 shows an eighteenth example of the arrangement of the first pump 25 and the second pump 26. As shown in FIG. 23, in the eighteenth example, the first pump 25 is connected to the drive shaft 8 via the intermediate shaft 31, as in the sixth example. The first pump 25 is disposed above the cavitation plate 14.

FIGS. 24 to 27 show nineteenth to twenty-second examples of the arrangement of the first pump 25 and the second pump 26. As shown in FIGS. 24 to 27, in the nineteenth to twenty-second examples, the drive shaft 8 includes the first drive shaft 8A and the second drive shaft 8B as in the eighth example.

Figure 24:
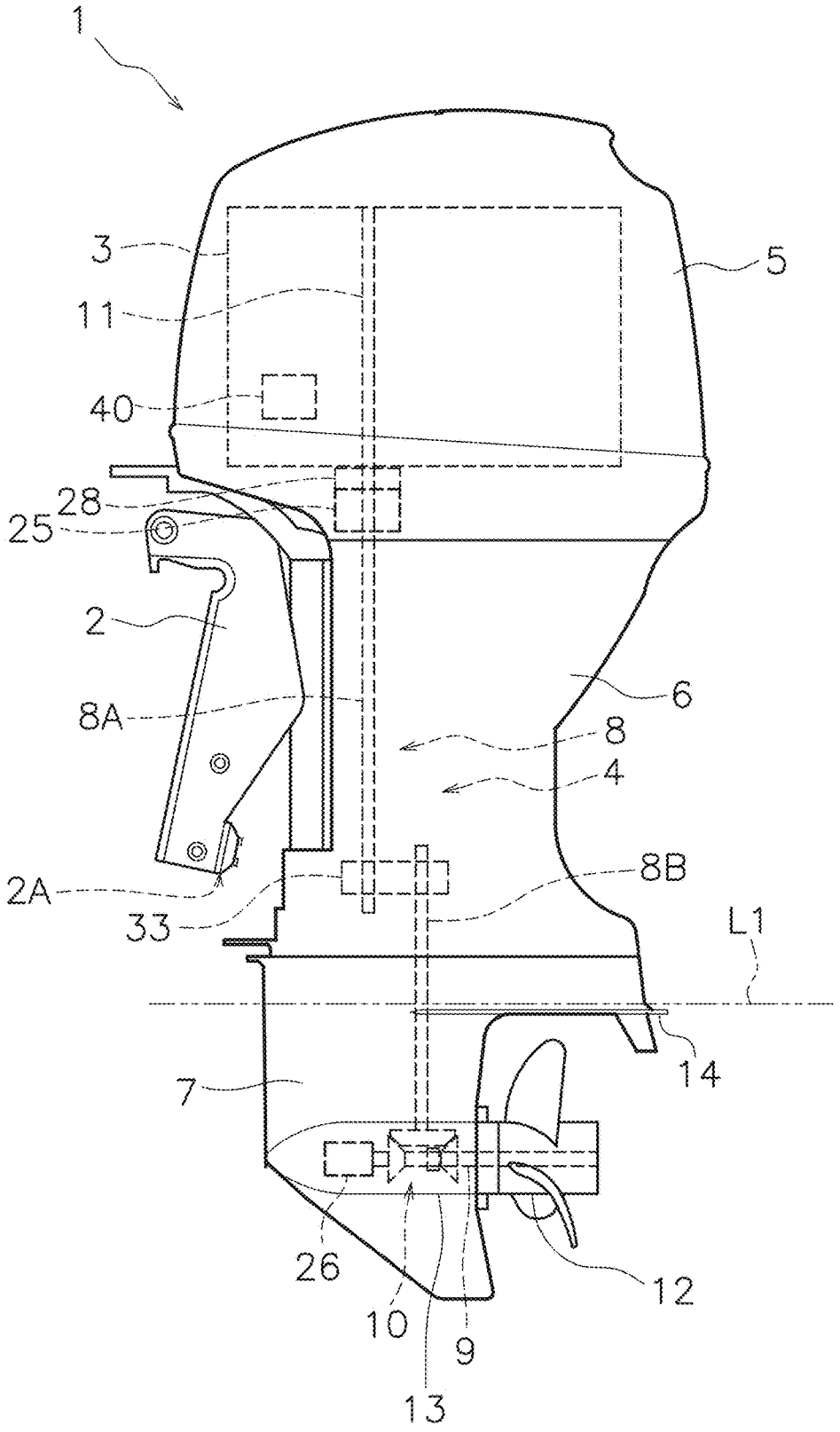
FIG. 24 is a diagram showing a nineteenth example of the arrangement of the first pump and the second pump.

FIG. 24 shows the nineteenth example of the arrangement of the first pump 25 and the second pump 26. In the nineteenth example, the first pump 25 is disposed directly below the crankshaft 11.

Figure 25:
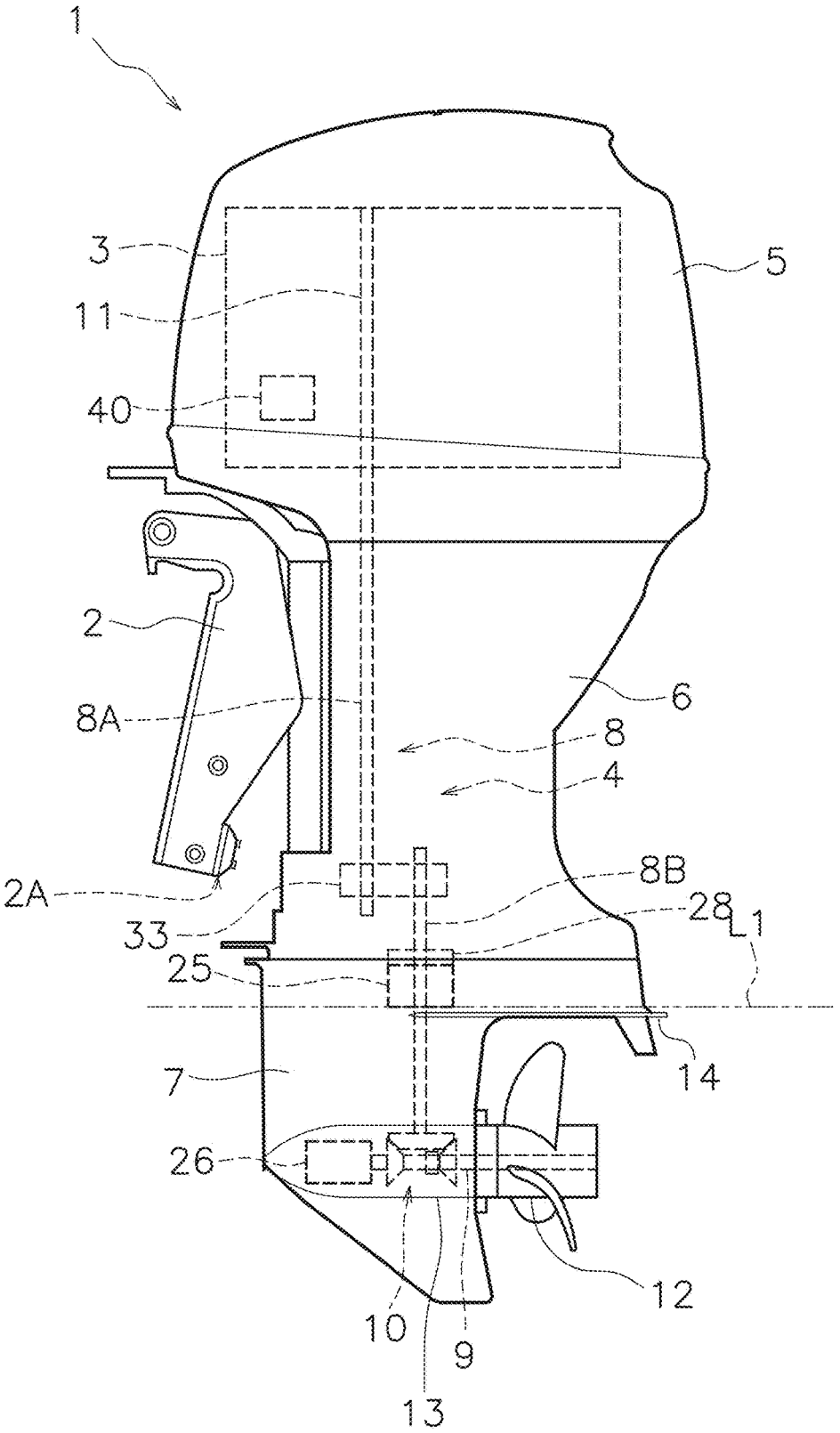
FIG. 25 is a diagram showing a twentieth example of the arrangement of the first pump and the second pump.

FIG. 25 shows the twentieth example of the arrangement of the first pump 25 and the second pump 26. In the twentieth example, the first pump 25 is connected to the second drive shaft 8B. The first pump 25 is disposed above the cavitation plate 14.

Figure 26:
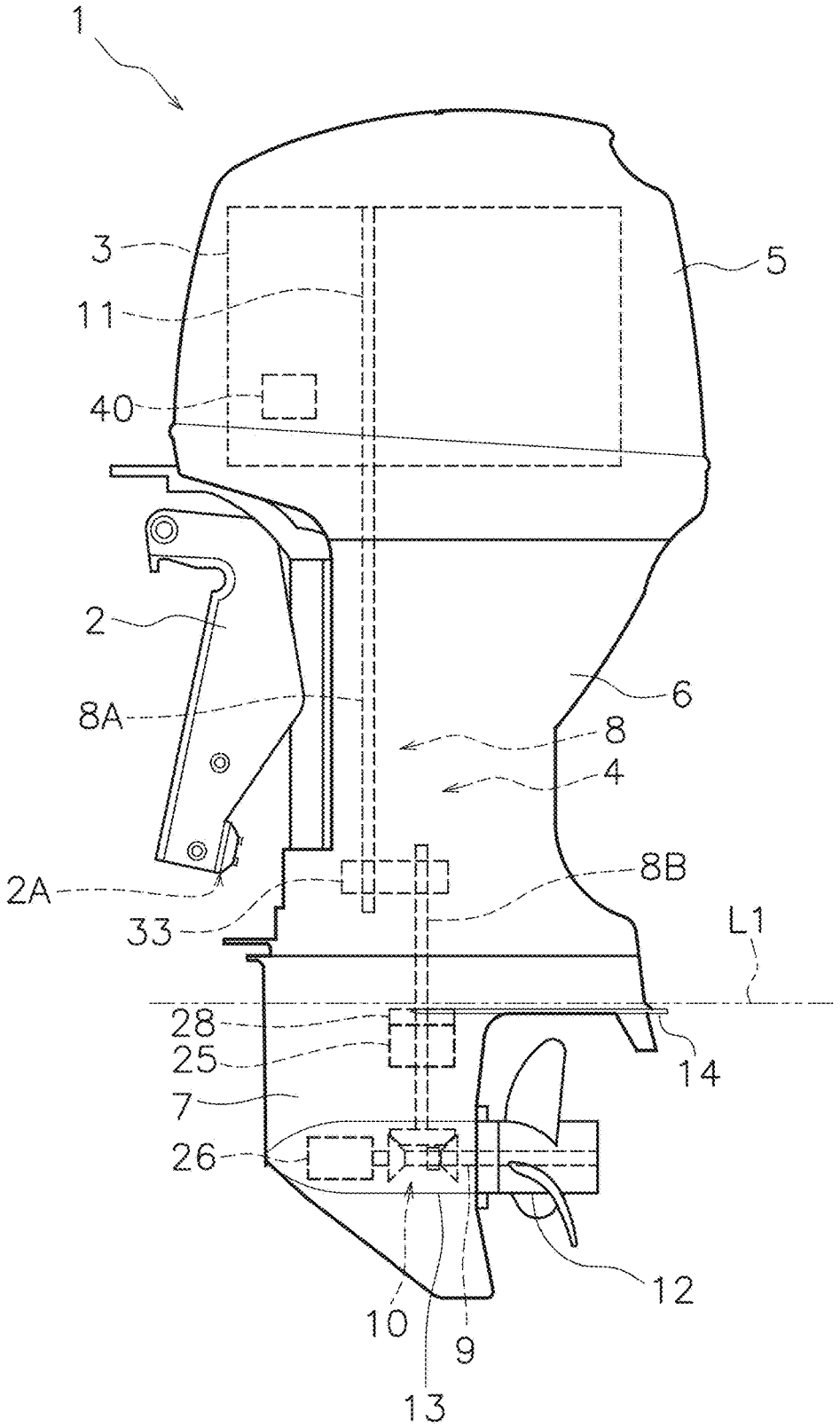
FIG. 26 is a diagram showing a twenty-first example of the arrangement of the first pump and the second pump.

FIG. 26 shows the twenty-first example of the arrangement of the first pump 25 and the second pump 26. In the twenty-first example, the first pump 25 is connected to the second drive shaft 8B. The first pump 25 is disposed below the cavitation plate 14.

Figure 27:
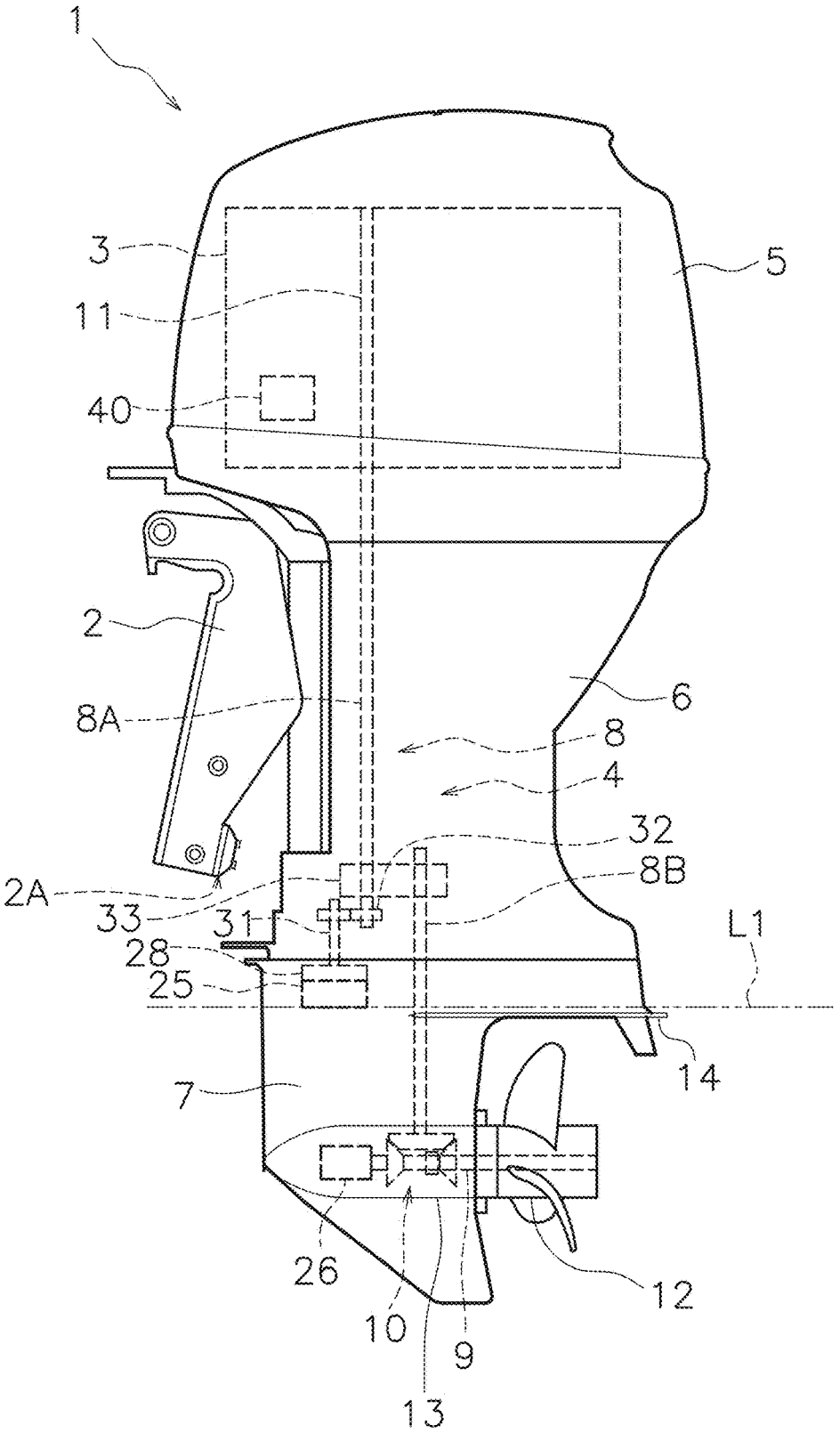
FIG. 27 is a diagram showing a twenty-second example of the arrangement of the first pump and the second pump.

FIG. 27 shows the twenty-second example of the arrangement of the first pump 25 and the second pump 26. In the twenty-second example, the first pump 25 is connected via the intermediate shaft 31 to the first drive shaft 8A. The first pump 25 is disposed above the cavitation plate 14.

Figure 28:
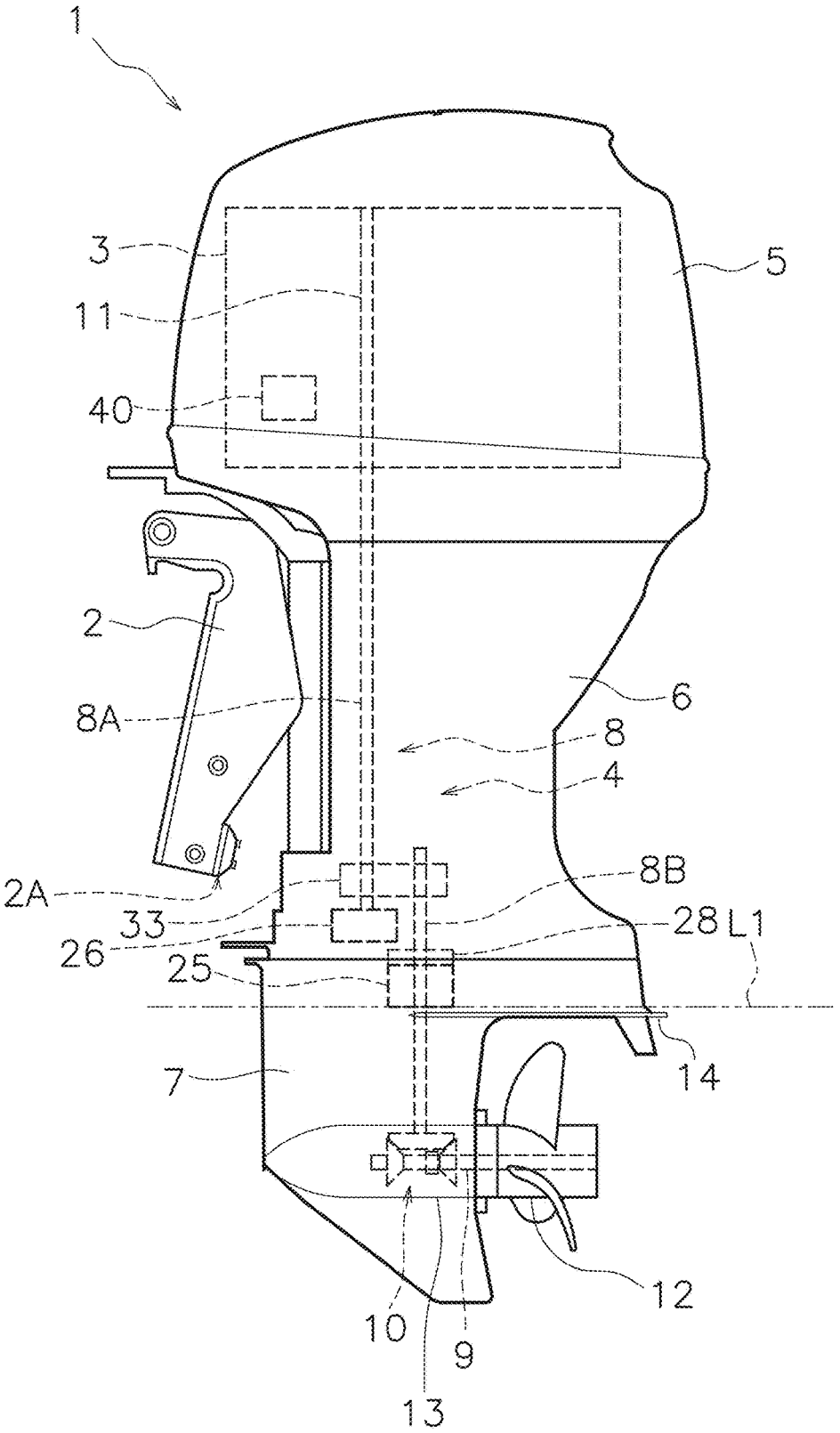
FIG. 28 is a diagram showing a twenty-third example of the arrangement of the first pump and the second pump.

FIG. 28 shows a twenty-third example of the arrangement of the first pump 25 and the second pump 26. In the twenty-third example, the second pump 26 is connected to the lower end of the first drive shaft 8A. Other configurations of the twenty-third example are the same as those of the eighth example shown in FIG. 12.

Figure 29:
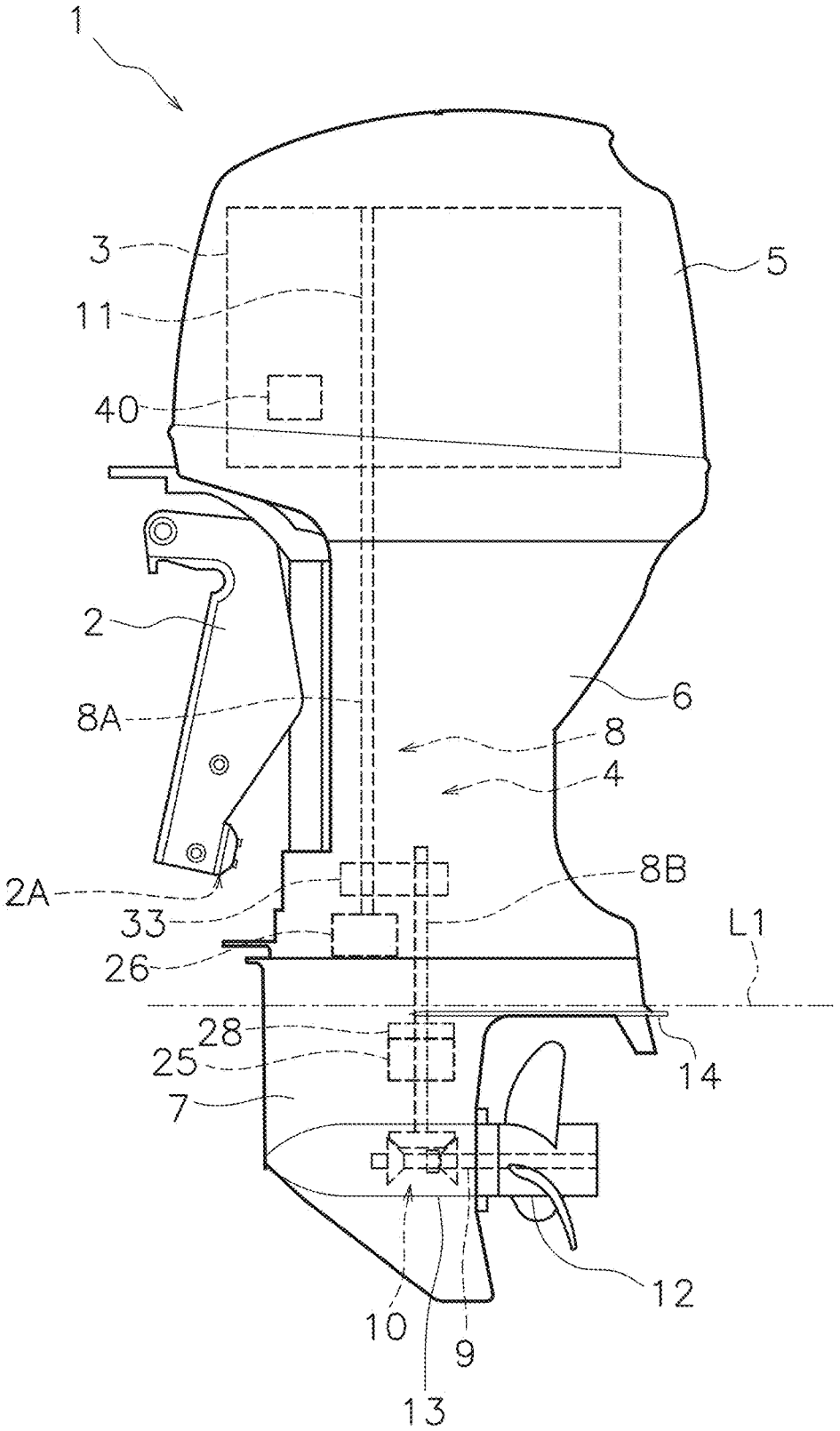
FIG. 29 is a diagram showing a twenty-fourth example of the arrangement of the first pump and the second pump.

FIG. 29 shows a twenty-fourth example of the arrangement of the first pump 25 and the second pump 26. In the twenty-fourth example, the second pump 26 is connected to the lower end of the first drive shaft 8A. Other configurations of the twenty-fourth example are similar to those of the ninth example shown in FIG. 13.

Figure 30:
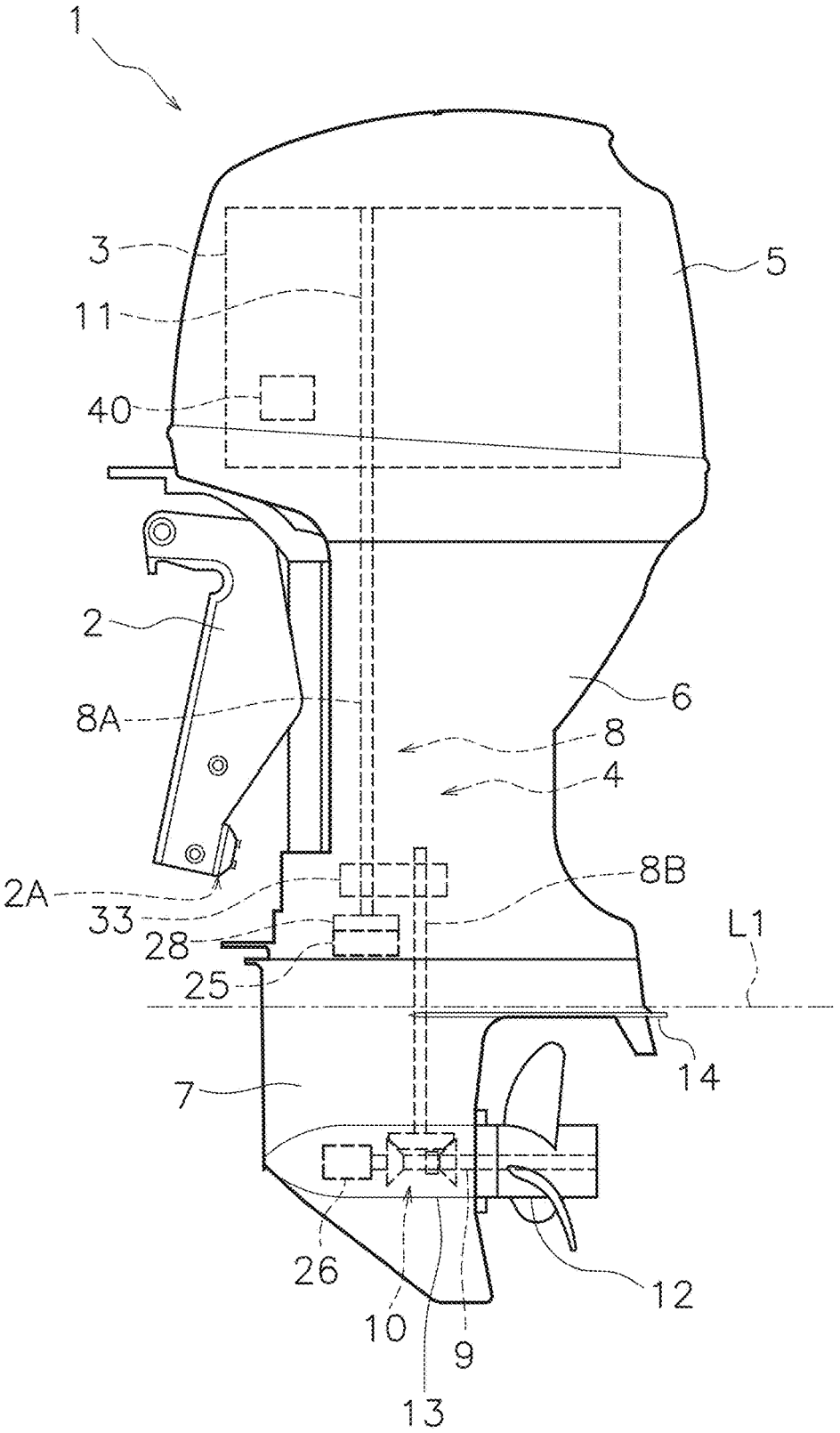
FIG. 30 is a diagram showing a twenty-fifth example of the arrangement of the first pump and the second pump.

FIG. 30 shows a twenty-fifth example of the arrangement of the first pump 25 and the second pump 26. In the twenty-fifth example, the first pump 25 is connected via the clutch 28 to the lower end of the first drive shaft 8A. Other configurations of the twenty-fifth example are similar to those of the nineteenth example shown in FIG. 24.

Figure 31:
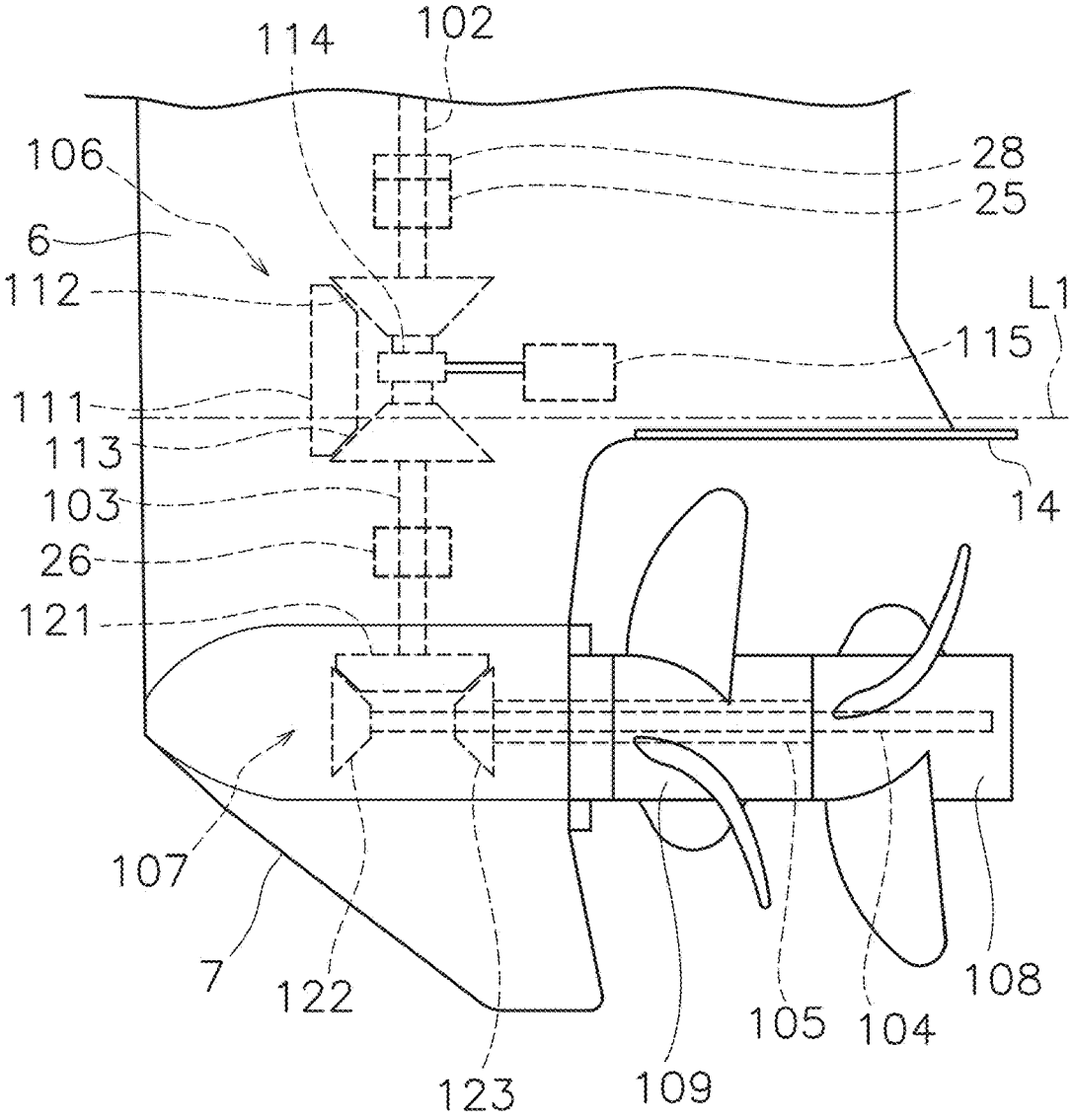
FIG. 31 is an enlarged side view showing a portion of an outboard motor according to a fourth preferred embodiment of the present invention.

FIG. 31 is a side view showing a portion of an outboard motor 1 according to a fourth preferred embodiment of the present invention. The outboard motor 1 according to the fourth preferred embodiment includes twin rotation propellers. As shown in FIG. 31, the outboard motor 1 includes a first drive shaft 102, a second drive shaft 103, a first propeller shaft 104, a second propeller shaft 105, a shift mechanism 106, and a gear mechanism 107.

The first drive shaft 102 is connected to the engine 3 and extends vertical direction of the outboard motor 1. The second drive shaft 103 is provided separately from the first drive shaft 102. The second drive shaft 103 is disposed below the first drive shaft 102 and extends in the vertical direction of the outboard motor 1. The first propeller shaft 104 extends in the front-rear direction of the outboard motor 1. The second propeller shaft 105 is coaxial with the first propeller shaft 104 on the outer peripheral side of the first propeller shaft 104. The second propeller shaft 105 is rotatable with respect to the first propeller shaft 104. A first propeller 108 is connected to the first propeller shaft 104. A second propeller 109 is connected to the second propeller shaft 105. The fins of the second propeller 109 are twisted in the opposite direction to the fins of the first propeller 108.

The shift mechanism 106 includes a first gear 111, a second gear 112, a third gear 113, and a clutch 114. The second gear 112 is coaxial with the first drive shaft 102. The first gear 111, the second gear 112, and the third gear 113 are bevel gears, for example. The second gear 112 is connected to the first drive shaft 102. The third gear 113 is coaxial with the second drive shaft 103. The third gear 113 is rotatable with respect to the second drive shaft 103. The first gear 111 is disposed between the second gear 112 and the third gear 113 and meshes with the second gear 112 and the third gear 113.

The clutch 114 is connected to an actuator 115 and operated by the actuator 115. The clutch 114 switches engagement and disengagement between the second gear 112 and the second drive shaft 103 and engagement and disengagement between the third gear 113 and the second drive shaft 103.

The gear mechanism 107 transmits the rotation of the second drive shaft 103 to the first propeller shaft 104 in a predetermined rotational direction, and transmits the rotation of the second drive shaft 103 to the second propeller shaft 105 in a direction opposite to the predetermined rotational direction. The gear mechanism 107 includes a first gear 121, a second gear 122, and a third gear 123.

The clutch 114 switches the shift mechanism 106 between a driving state and a neutral state. The shift mechanism 106 transmits the driving force from first drive shaft 102 to the second drive shaft 103 in the driving state. The driving state includes a forward state and a reverse state.

In the forward state, the clutch 114 engages the second gear 112 and the second drive shaft 103 and disengages the third gear 113 and the second drive shaft 103. Thus, the rotation of the first drive shaft 102 is transmitted to the second drive shaft 103 in the same rotational direction. The rotation of the second drive shaft 103 is transmitted to the first propeller 108 via the first gear 121 and the second gear 122 of the gear mechanism 107 and the first propeller shaft 104. Also, the rotation of the second drive shaft 103 is transmitted to the second propeller 109 via the first gear 121 and the third gear 123 of the gear mechanism 107 and the second propeller shaft 105. Thus, the first propeller 108 and the second propeller 109 rotate in the forward directions. The forward directions of the first propeller 108 and the second propeller 109 are opposite to each other.

In the reverse state, the clutch 114 disengages the second gear 112 and the second drive shaft 103 and engages the third gear 113 and the second drive shaft 103. As a result, the rotation of the first drive shaft 102 is transmitted to the second drive shaft 103 via the second gear 112, the first gear 111, and the third gear 113 in the direction opposite to the rotation of the first drive shaft 102. The rotation of the second drive shaft 103 is transmitted to the first propeller 108 via the first gear 121 and the second gear 122 of the gear mechanism 107 and the first propeller shaft 104. Also, the rotation of the second drive shaft 103 is transmitted to the second propeller 109 via the first gear 121 and the third gear 123 of the gear mechanism 107 and the second propeller shaft 105. As a result, the first propeller 108 and the second propeller 109 rotate in the reverse directions.

In the neutral state, the clutch 114 disengages the second gear 112 and the second drive shaft 103 and disengages the third gear 113 and the second drive shaft 103. The shift mechanism 106 does not transmit the driving force from the first drive shaft 102 to the second drive shaft 103 in the neutral state. Contrary to the above, the rotation directions of the first propeller 108 and the second propeller 109 may be opposite to those described above in the forward state and the reverse state. Other configurations of the outboard motor 1 according to the fourth preferred embodiment are the same as those of the outboard motor 1 according to the above-described first preferred embodiment.

Figure 32:
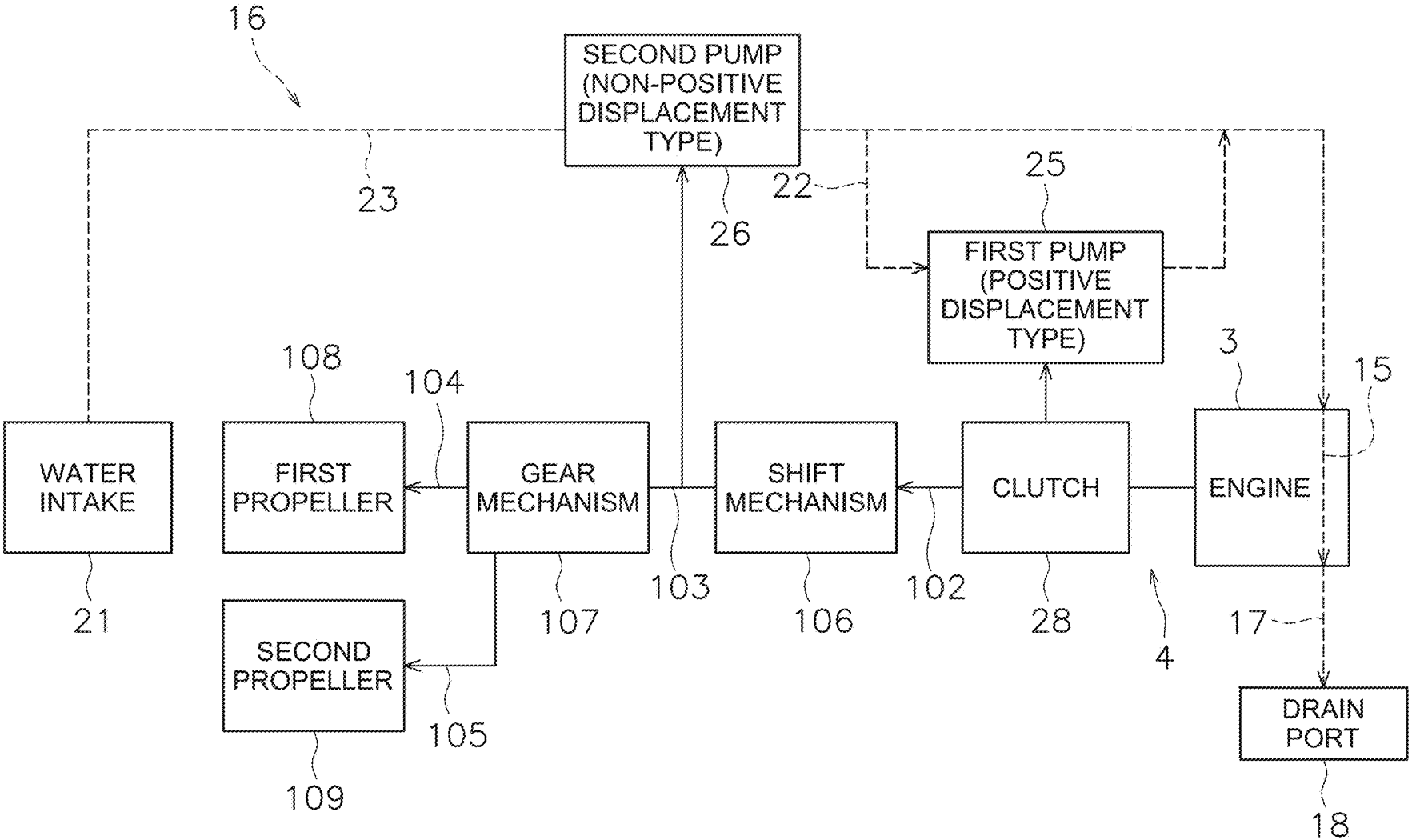
FIG. 32 is a block diagram showing the cooling system of the outboard motor according to the fourth preferred embodiment of the present invention.

FIG. 32 is a block diagram showing the cooling system and the drive system of the outboard motor 1 according to the fourth preferred embodiment. As shown in FIG. 32, the first pump 25 is connected to the first drive shaft 102 via the clutch 28 in the fourth preferred embodiment. The second pump 26 is connected to the second drive shaft 103. The first pump 25 is a positive displacement pump. The second pump 26 is a non-positive displacement pump.

As shown in FIG. 31, for example, the first pump 25 is disposed above the cavitation plate 14. The first pump 25 is disposed above the waterline L1. The second pump 26 is disposed below the cavitation plate 14. The second pump 26 is disposed below the waterline L1. Alternatively, the first pump 25 and the second pump 26 may be disposed as in the first to twenty-fifth examples described above.

When the clutch 28 is in the engaged state, the driving force from the engine 3 is transmitted to the first pump 25 via the transmission mechanism 4 and the clutch 28. Thus, the first pump 25 is driven by the driving force of the engine 3 to send the cooling water to the engine 3 through the cooling water passage 16. When the clutch 28 is in the disengaged state, the driving force from the engine 3 is not transmitted to the first pump 25 and the first pump 25 is not driven.

The second pump 26 is always connected to the second drive shaft 103. Therefore, when the engine 3 is running and the shift mechanism 106 is in the driving state, the driving force from the engine 3 is always transmitted to the second pump 26. Thus, the second pump 26 is driven by the driving force of the engine 3 to send the cooling water to the engine 3 through the cooling water passage 16.

However, even if the engine 3 is driven, the driving force from the engine 3 is not transmitted to the second drive shaft 103 when the shift mechanism 106 is in the neutral state. Therefore, when the shift mechanism 106 is in the neutral state, the driving force from the engine 3 is not transmitted to the second pump 26 even if the engine 3 is being driven, and the second pump 26 is not driven.

In the fourth preferred embodiment, when the shift mechanism 106 is in the driving state and the engine speed is in the low speed range, the clutch 28 connects the first pump 25 and the first drive shaft 102, and the first pump 25 and the second pump 26 are driven. Thus, the cooling water is sent to the engine 3 by both the first pump 25 and the second pump 26.

When the shift mechanism 106 is in the driving state and the engine speed is in the high speed range, the clutch 28 disconnects the first pump 25 and the first drive shaft 102, and the second pump 26 is driven. Thus, the first pump 25 is not driven, and the cooling water is sent to the engine 3 only by the second pump 26.

When the shift mechanism 106 is in the neutral state, the clutch 28 connects the first pump 25 and the first drive shaft 102 and the first pump 25 is driven regardless of the engine speed. Thus, the second pump 26 is not driven, and the cooling water is sent to the engine 3 only by the first pump 25.

In the fourth preferred embodiment, when the shift mechanism 106 is in the driving state, the state in which the cooling water is supplied to the engine 3 by both the first pump 25 and the second pump 26 and the state in which the cooling water is supplied to the engine 3 only by the second pump 26 are switched according to the engine speed. Thus, an appropriate amount of cooling water is supplied to the engine 3 to cool the engine 3. Moreover, the loss of the driving force of the engine 3 is suppressed.

When the shift mechanism 106 is in the neutral state, no driving force is transmitted to the second drive shaft 103, but the cooling water is sent to the engine 3 by the first pump 25. Thus, for example, even when the engine 3 is idling, an appropriate amount of cooling water is supplied to the engine 3 to cool the engine 3.

Although preferred embodiments of the present invention have been described above, the present invention is not limited to the above preferred embodiments, and various modifications are possible without departing from the gist of the present invention.

The configuration of the outboard motor 1 is not limited to that of the above preferred embodiments, and may be modified. The configuration of the cooling water passage 16 is not limited to that of the above preferred embodiments, and may be modified. For example, the number of water intakes is not limited to one, and may be two or more. The first passage 22 and the second passage 23 may be connected to separate water intakes. The first passage 22 and the second passage 23 do not have to join downstream of the pumps 25 and 26. That is, the first passage 22 and the second passage 23 may be connected to the water jacket 15 of the engine 3 independently of each other.

In the above preferred embodiments, the clutch 28 is switched according to the engine speed. However, the clutch 28 may be switched based on a parameter such as the cooling water temperature of the engine 3, the exhaust temperature, or the oil temperature.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor comprising:
a bracket to mount the outboard motor on a watercraft;
an engine;
an upper case below the engine;
a lower case below the upper case;
a transmission to transmit a driving force of the engine;
a clutch connected to the transmission;
a cooling water passage connected to the engine and located in the upper case and the lower case;
a first pump connected to the transmission via the clutch and driven by the driving force of the engine to send cooling water to the engine via the cooling water passage; and
a second pump connected to the transmission and driven by the driving force of the engine to send the cooling water to the engine through the cooling water passage.

2. An outboard motor comprising:
a bracket to mount the outboard motor on a watercraft;
an engine;
an upper case below the engine;
a lower case below the upper case;
a transmission to transmit a driving force of the engine;
a clutch connected to the transmission;
a cooling water passage connected to the engine and located in the upper case and the lower case;
a first pump connected to the transmission via the clutch and driven by the driving force of the engine to send cooling water to the engine via the cooling water passage; and
a second pump connected to the transmission and driven by the driving force of the engine to send the cooling water to the engine through the cooling water passage; wherein
the first pump and the second pump are positive displacement pumps;
when a rotation speed of the engine is in a lower speed range, the clutch disconnects the first pump and the transmission and the second pump is driven; and
when the rotation speed of the engine is in a higher speed range, the clutch connects the first pump and the transmission and the first pump and the second pump are driven.

3. An outboard motor comprising:
a bracket to mount the outboard motor on a watercraft;
an engine;
an upper case below the engine;
a lower case below the upper case;
a transmission to transmit a driving force of the engine;
a clutch connected to the transmission;
a cooling water passage connected to the engine and located in the upper case and the lower case;
a first pump connected to the transmission via the clutch and driven by the driving force of the engine to send cooling water to the engine via the cooling water passage; and
a second pump connected to the transmission and driven by the driving force of the engine to send the cooling water to the engine through the cooling water passage; wherein
the first pump is a positive displacement pump;
the second pump is a non-positive displacement pump;
when a rotational speed of the engine is in a lower speed range, the clutch connects the first pump and the transmission and the first pump and the second pump are driven; and
when the rotation speed of the engine is in a higher speed range, the clutch disconnects the first pump and the transmission and the second pump is driven.

4. An outboard motor comprising:
a bracket to mount the outboard motor on a watercraft;
an engine;
an upper case below the engine;
a lower case below the upper case;
a transmission to transmit a driving force of the engine;
a clutch connected to the transmission;
a cooling water passage connected to the engine and located in the upper case and the lower case;
a first pump connected to the transmission via the clutch and driven by the driving force of the engine to send cooling water to the engine via the cooling water passage; and
a second pump connected to the transmission and driven by the driving force of the engine to send the cooling water to the engine through the cooling water passage; wherein
the transmission includes:
a first shaft connected to the engine;
a shifter connected to the first shaft; and
a second shaft connected to the shifter;
the shifter is switchable between a driving state in which the first shaft and the second shaft are connected and a neutral state in which the first shaft and the second shaft are disconnected;
the first pump is connected to the first shaft; and
the second pump is connected to the second shaft.

5. The outboard motor according to claim 4, wherein
the first shaft is a drive shaft extending downward from the engine and located in the upper case and the lower case; and
the second shaft is a propeller shaft connected to the drive shaft via the shifter, extends in a front-rear direction of the outboard motor, and is located in the lower case.

6. The outboard motor according to claim 4, wherein
the transmission includes:
a drive shaft extending downward from the engine and located in the upper case and the lower case; and
a propeller shaft connected to the drive shaft, extends in a front-rear direction of the outboard motor, and is located in the lower case;
the drive shaft includes:
a first drive shaft connected to the engine; and
a second drive shaft connected to the first drive shaft via the shifter;
the first shaft is the first drive shaft; and
the second shaft is the second drive shaft.

7. The outboard motor according to claim 4, wherein
the first pump is a positive displacement pump;
the second pump is a non-positive displacement pump;

when the shifter is in the driving state and a rotational speed of the engine is in a lower speed range, the clutch connects the first pump and the first shaft and the first pump and the second pump are driven;

when the shifter is in the driving state and the rotational of the engine is in a higher speed range, the clutch disconnects the first pump and the first shaft and the second pump is driven; and when the shifter is in the neutral state, the clutch connects the first pump and the first shaft and the first pump is driven.

* * * * *